US009011119B2

(12) United States Patent
Imanaga

(10) Patent No.: US 9,011,119 B2
(45) Date of Patent: Apr. 21, 2015

(54) VARIABLE DISPLACEMENT PUMP

(71) Applicant: Hitachi Automotive Systems Steering, Ltd., Hiki-gun, Saitama (JP)

(72) Inventor: Hiroki Imanaga, Atsugi (JP)

(73) Assignee: Hitachi Automotive Systems Steering, Ltd., Hiki-gun (JP)

( * ) Notice: Subject to any disclaimer, the term of this patent is extended or adjusted under 35 U.S.C. 154(b) by 233 days.

(21) Appl. No.: 13/784,502

(22) Filed: Mar. 4, 2013

(65) Prior Publication Data

US 2013/0251584 A1 Sep. 26, 2013

(30) Foreign Application Priority Data

Mar. 22, 2012 (JP) ..... 2012-065598

(51) Int. Cl.

| | |
|---|---|
| ***F03C 2/00*** | (2006.01) |
| ***F04C 2/344*** | (2006.01) |
| ***F04C 2/00*** | (2006.01) |
| ***F01C 21/10*** | (2006.01) |
| ***F04C 14/22*** | (2006.01) |
| *F01C 21/08* | (2006.01) |

(52) U.S. Cl.

CPC ..... *F04C 2/00* (2013.01); *F01C 21/108* (2013.01); *F04C 2/3442* (2013.01); *F04C 14/226* (2013.01); *F01C 21/0863* (2013.01)

(58) Field of Classification Search

CPC ..... F04C 2/00; F04C 14/226; F04C 2/3442; F01C 21/108; F01C 21/0863

USPC ..... 418/1, 30, 31; 417/219, 220, 410.3

See application file for complete search history.

(56) References Cited

U.S. PATENT DOCUMENTS

| | | | | |
|---|---|---|---|---|
| 6,042,343 | A * | 3/2000 | Semba et al. | 417/220 |
| 6,524,076 | B2 * | 2/2003 | Konishi | 417/213 |
| 7,070,399 | B2 * | 7/2006 | Konishi et al. | 417/410.3 |
| 7,832,995 | B2 * | 11/2010 | Yamamuro et al. | 418/31 |
| 8,267,671 | B2 * | 9/2012 | Soeda et al. | 417/220 |
| 2007/0148029 | A1 * | 6/2007 | Yamamuro et al. | 418/30 |
| 2008/0118381 | A1 | 5/2008 | Yamamuro et al. | |
| 2009/0081052 | A1 * | 3/2009 | Soeda et al. | 417/213 |

FOREIGN PATENT DOCUMENTS

| | | | |
|---|---|---|---|
| JP | 2008-115706 | A | 5/2008 |

* cited by examiner

*Primary Examiner* — Hoang Nguyen
(74) *Attorney, Agent, or Firm* — Foley & Lardner LLP

(57) ABSTRACT

A variable displacement pump includes: a discharge opening formed at a position to confront a discharge region; a back pressure introduction groove formed on the suction region side; and a discharge side thin wall portion which is formed in the second housing, which has a recessed shape opened to the outside, which is disposed on the discharge region side, which is overlapped with the rotor in the radial direction, and which includes a smallest thickness portion having a smallest wall thickness of thicknesses each of which is an axial length between a bottom surface of the recessed shape and an axially inner side surface of the second housing, the smallest wall thickness being a smallest wall thickness of axial thicknesses of the second housing.

20 Claims, 10 Drawing Sheets

VARIABLE DISPLACEMENT PUMP

BACKGROUND OF THE INVENTION

This invention relates to a variable displacement pump.

U.S. Patent Application Publication No. 2008/0118381 (corresponding to Japanese Patent Application Publication No. 2008-115706) discloses a variable displacement vane pump. In this variable displacement vane pump, a region of a substantially half of circumference with respect to a rotational direction of a rotor is a suction region, and a region of a substantially half of circumference is a discharge region.

SUMMARY OF THE INVENTION

In the above-described vane pump, a suction passage is formed in a portion of the rear body which corresponds to the suction region side. A portion of the rear body which corresponds to the discharge region side is formed into a solid state (tight state). Moreover, a discharge pressure is acted to all circumferences of base ends (back pressure chambers) of slots in which vanes are received. Accordingly, the rigidity is relatively low in the portion of the rear body which corresponds to the suction region. Consequently, when a high discharge pressure is acted, a amount of change of shape becomes larger in the portion of the rear body which corresponds to the suction region, relative to a portion of the rear body which corresponds to the discharge region. Therefore, a surface of the rear body on the rotor's side does not become flat, and the galling may be likely to be generated between the rotor and the rear body.

It is, therefore, an object of the present invention to provide a variable displacement pump devised to suppress the galling between a rear body (second housing) and a rotor.

According to one aspect of the present invention, a variable displacement pump comprises: a pump housing including a first housing including a cylindrical portion, and a bottom portion closing one axial side of the cylindrical portion, and a second housing closing the other axial side of the cylindrical portion; a drive shaft rotatably supported by the pump housing; an annular cam ring movably provided within the cylindrical portion of the first housing; a rotor provided within the cam ring, and driven and rotated by the drive shaft; a plurality of slits formed in the rotor in a circumferential direction; a plurality of vanes each of which is provided within one of the slits to be moved into and out of the one of the slits, and which separate a plurality of pump chambers with the cam ring and the rotor; a pressure plate provided within the cylindrical portion of the first housing between the bottom portion of the first housing and the cam ring, and pressed toward the cam ring by a discharge pressure discharged from the pump chambers; a suction opening formed in the second housing, and formed at a position to confront a suction region in which volumes of the plurality of pump chambers are increased in accordance with the rotation of the rotor; a suction passage formed in the second housing, and arranged to introduce a hydraulic fluid from an outside of the pump housing to the suction opening; a discharge opening formed in one of the pressure plate and the second housing, and formed at a position to confront a discharge region in which the volumes of the plurality of the pump chambers are decreased in accordance with the rotation of the rotor; a discharge passage formed in the pump housing, and arranged to discharge a discharge hydraulic fluid which is the hydraulic fluid discharged from the discharge region, to the outside of the pump housing; a back pressure introduction groove which is formed in the second housing, which has an arc shape to confront base end portions of the slits that are radially innermost ends of the slits, which is formed at least on the suction region side, and which is arranged to protrude the vanes in the radially outside direction by receiving a part of the discharge hydraulic fluid; and a discharge side thin wall portion which is formed in the second housing, which has a recessed shape opened to the outside, which is disposed on the discharge region side, which is overlapped with the rotor in the radial direction, and which includes a smallest thickness portion having a smallest wall thickness of thicknesses each of which is an axial length between a bottom surface of the recessed shape and an axially inner side surface of the second housing, the smallest wall thickness being a smallest wall thickness of axial thicknesses of the second housing.

According to another aspect of the invention, a variable displacement pump comprises: a pump housing including a first housing including a cylindrical portion, and a bottom portion closing one axial side of the cylindrical portion, and a second housing closing the other axial side of the cylindrical portion; a drive shaft rotatably supported by the pump housing; an annular cam ring movably provided within the cylindrical portion of the first housing; a rotor provided within the cam ring, and driven and rotated by the drive shaft; a plurality of slits formed in the rotor in a circumferential direction; a plurality of vanes each of which is provided within one of the slits to be moved into and out of the one of the slits, and which separate a plurality of pump chambers with the cam ring and the rotor; a pressure plate provided within the cylindrical portion of the first housing between the bottom portion of the first housing and the cam ring, and pressed toward the cam ring by a discharge pressure discharged from the pump chambers; a suction opening formed in the second housing, and formed at a position to confront a suction region in which volumes of the plurality of pump chambers are increased in accordance with the rotation of the rotor; a suction passage formed in the second housing, and arranged to introduce a hydraulic fluid from an outside of the pump housing to the suction opening; a discharge opening formed in the second housing, and formed at a position to confront a discharge region in which the volumes of the plurality of the pump chambers are decreased in accordance with the rotation of the rotor; a discharge passage formed in the pump housing, and arranged to discharge a discharge hydraulic fluid which is the hydraulic fluid discharged from the discharge region, to the outside of the pump housing; a back pressure introduction groove which is formed in the second housing, which has an arc shape to confront base end portions of the slits that are radially innermost ends of the slits, which is formed on the suction region side and the discharge region side, and which is arranged to protrude the vanes in the radially outer direction by receiving a part of the discharge hydraulic fluid; and a discharge side thin wall portion which is formed in the second housing, which has a recessed shape opened to the outside, which is disposed on the discharge region side, and which is radially overlapped with a region between the back pressure introduction groove and the discharge opening, the recessed shape of the discharge side thin wall portion having a substantially arc shape having a circumferential length longer than a radial length.

According to still another aspect of the invention, a variable displacement pump comprises: a pump housing including a first housing including a cylindrical portion, and a bottom portion closing one axial side of the cylindrical portion, and a second housing closing the other axial side of the cylindrical portion; a first shaft insertion hole formed in the first housing; a second shaft insertion hole which is formed in the second housing, and which including an opening opened toward the first housing, and a bottom portion; a drive shaft rotatably supported within the first shaft insertion hole and the second shaft insertion hole; an annular cam ring movably provided within the cylindrical portion; an annular cam ring movably provided within the cylindrical portion of the first housing; a rotor provided within the cam ring, and driven and rotated by the drive shaft; a plurality of slits formed in the rotor in a circumferential direction; a plurality of vanes each of which is provided within one of the slits to be moved into and out of the one of the slits, and which separate a plurality of pump chambers with the cam ring and the rotor; a pressure plate provided within the cylindrical portion of the first housing between the bottom portion of the first housing and the cam ring, and pressed toward the cam ring by a discharge pressure discharged from the pump chambers; a suction opening formed in the second housing, and formed at a position to confront a suction region in which volumes of the plurality of pump chambers are increased in accordance with the rotation of the rotor; a suction passage formed in the second housing, and arranged to introduce a hydraulic fluid from an outside of the pump housing to the suction opening; a discharge opening formed in the second housing, and formed at a position to confront a discharge region in which the volumes of the plurality of the pump chambers are decreased in accordance with the rotation of the rotor; a discharge passage formed in the pump housing, and arranged to discharge a discharge hydraulic fluid which is the hydraulic fluid discharged from the discharge region, to the outside of the pump housing; a back pressure introduction groove which is formed in the second housing, which has an arc shape to confront base end portions of the slits that are radially innermost ends of the slits, which is formed on the suction region side and the discharge region side, and which is arranged to protrude the vanes in the radially outside direction by receiving a part of the discharge hydraulic fluid; and a discharge side thin wall portion which is formed in the second housing, which has a recessed shape opened to the outside, which is disposed on the discharge region side, which is radially overlapped with a region between the back pressure introduction groove and the discharge opening, and which includes a smallest thickness portion that has a smallest wall thickness of thicknesses each of which is an axial length between a bottom surface of the recessed shape and an axially inner side surface of the second housing, and that includes a bottom surface positioned between the first housing and a bottom surface of the second shaft insertion hole.

DETAILED DESCRIPTION OF THE INVENTION

First Embodiment

Summary of Vane Pump

Figure 1:
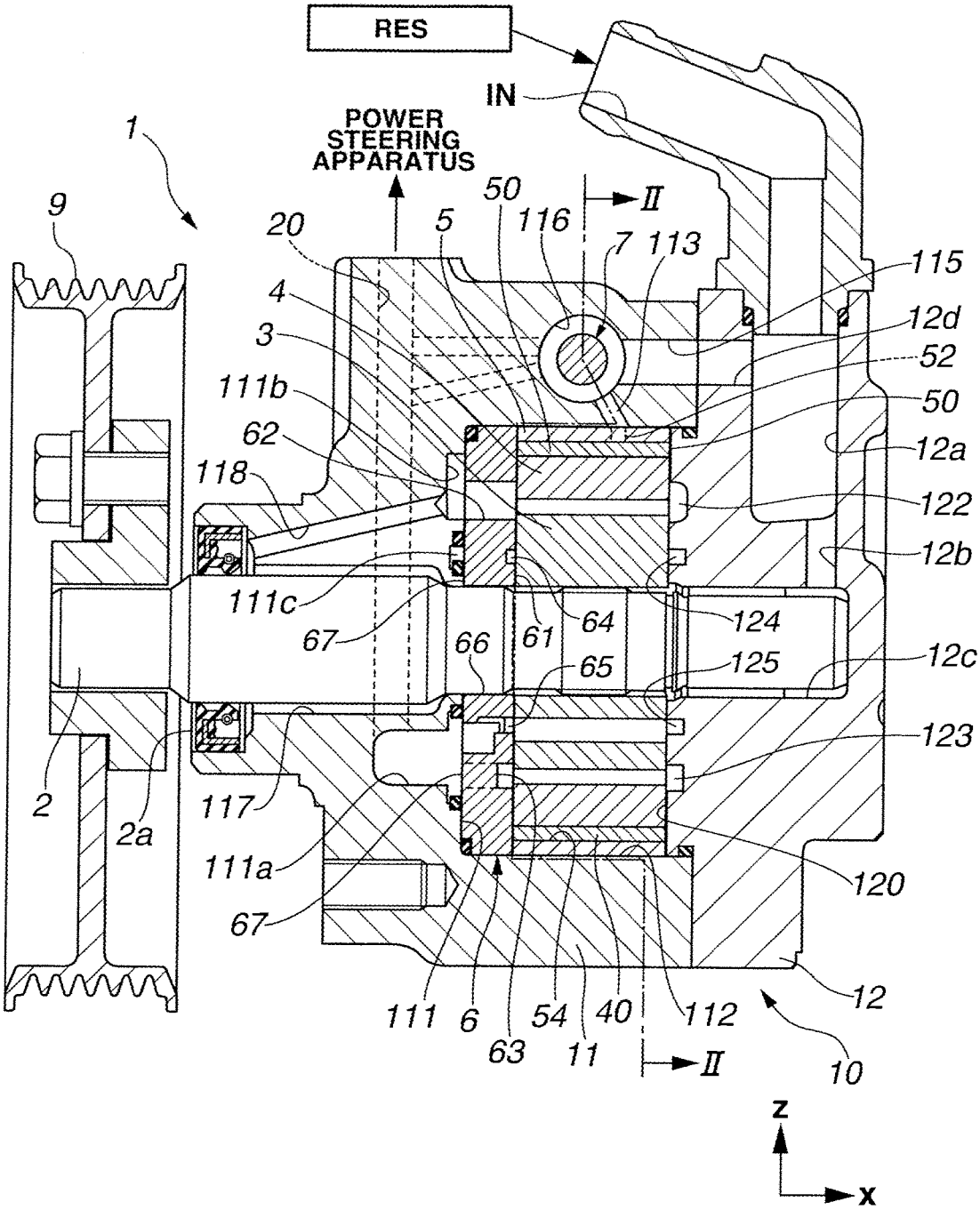
FIG. 1 is an axial sectional view showing a variable displacement vane pump according to a first embodiment of the present invention.
Figure 2:
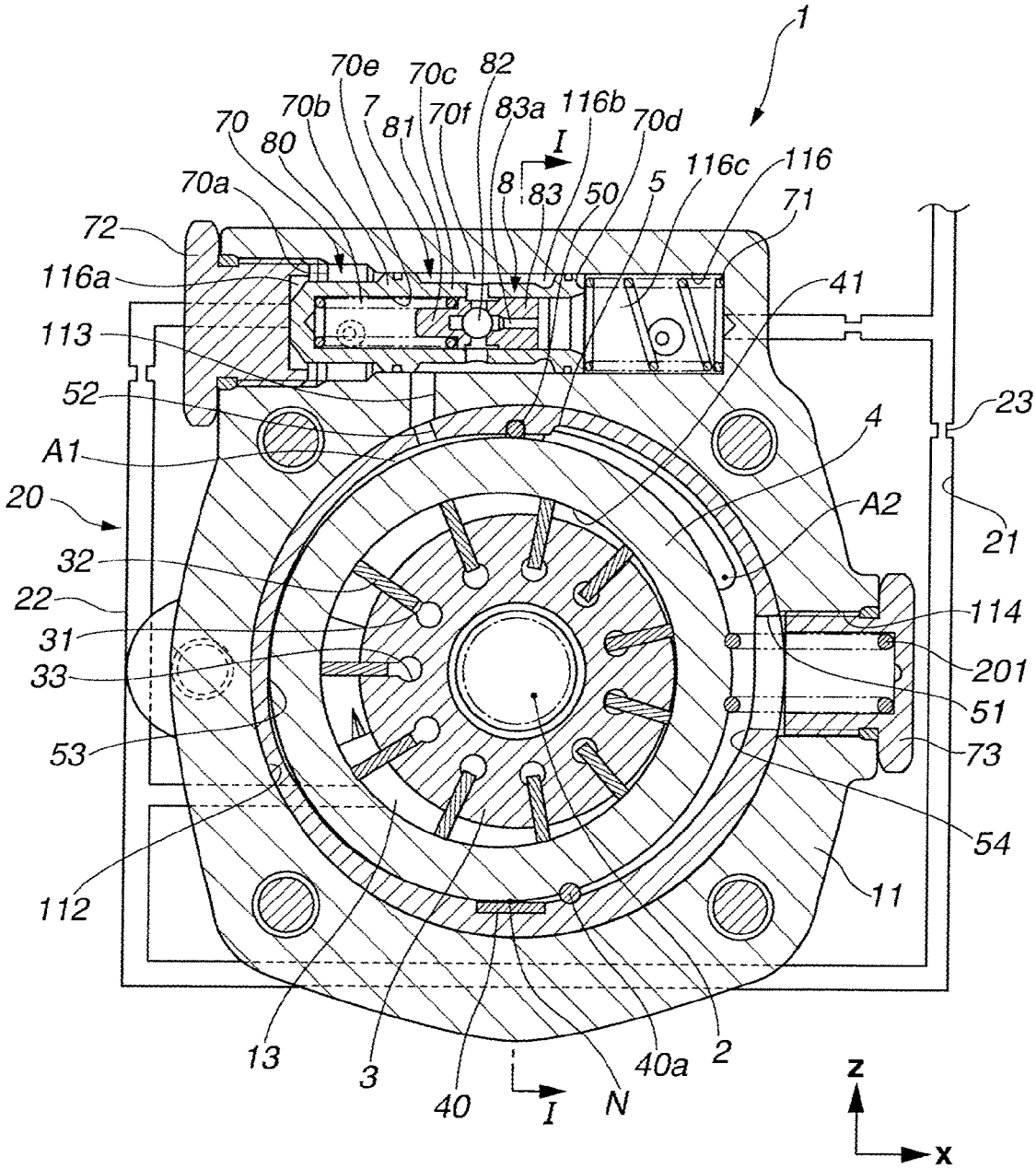
FIG. 2 is a radial sectional view which shows the variable displacement vane pump of FIG. 1, and which is taken along a section line II-II of FIG. 1.

FIG. 1 is an axial sectional view showing a variable displacement vane pump 1 according to a first embodiment of the present invention (a sectional view taken along a section line I-I of FIG. 2). FIG. 2 is a radial sectional view of the variable displacement vane pump 1 (a sectional view taken along a section line II-II of FIG. 1). FIG. 2 shows a state in which a cam ring 4 is positioned at a furthest position in a y-axis direction (maximum eccentric amount).

Variable displacement vane pump 1 according to the first embodiment is arranged to supply a hydraulic fluid to a power steering apparatus mounted on a vehicle. In this variable displacement vane pump 1, a drive shaft 2 is connected with a pulley 9 arranged to be driven by an engine (not shown) through a belt and so on. The sectional view of FIG. 2 schematically shows a structure and so on of hydraulic passages for readily illustrating function of the pump. Besides, an x-axis direction is defined by an axial direction of drive shaft 2. A positive direction is defined by a direction in which drive shaft 2 is inserted into a pump body 10. A negative direction of a y-axis is defined by a direction which is an axial direction of a cam spring 201 (cf. FIG. 2) arranged to restrict a swing movement of cam ring 4, and in which cam spring 201 urges cam ring 4. A positive direction of a z-axis is a direction which is an axis perpendicular to the x-axis and the y-axis, on a suction passage IN's side. The vane pump according to the first embodiment increases a pressure of the hydraulic fluid sucked from a reservoir tank RES to a necessary pressure. The vane pump is arranged to supply a necessary flow rate (flow amount) to the power steering apparatus.

The variable displacement vane pump 1 includes drive shaft 2, a rotor 3, cam ring 4, an adapter ring 5, and a pump body 10. The drive shaft 2 is connected through pulley 9 to the engine. The drive shaft 2 is rotatably supported by pump body 10. The rotor 3 is a rotatable (rotary) member which is driven and rotated by drive shaft 2. This rotor 3 includes a plurality of slits 31 each of which is an axial groove that is formed in an outer circumference of the rotor 3, and that extends in the radial direction. A plate-shaped vane 32 is inserted into each of the slits 31 to be moved in a radially outward direction and in a radially inward direction. Each of vanes 32 has a length in the x-axis direction which is substantially identical to that of rotor 3. Moreover, the rotor 3 includes a plurality of back pressure chambers 33 each of which is formed at a radially inner end of one of the slits 31, and each of which is arranged to urge one of the vanes 32 by receiving the hydraulic fluid.

Pump body 10 includes a front body 11 and a rear body 12. Front body 11 has a bottomed cup shape having an opening opened on the positive side of the x-axis direction. Front body 11 includes a cylindrical pump element receiving portion 112 which is formed on an inner circumference portion of front body 11. The x-axis negative side of front body 11 is closed by a bottom portion 111. A disc-shaped pressure plate 6 is received on this bottom portion 111. Front body 11 and rear body 12 are fixed by being fastened by a plurality of bolts. Adapter ring 5, cam ring 4, and rotor 3 are received within the pump element receiving portion 112 on the x-axis positive side of pressure plate 6. Rear body 12 is liquid-tightly abutted on adapter ring 5, cam ring 4, and rotor 3 from the x-axis positive side. Adapter ring 5, cam ring 4, and rotor 3 are sandwiched between pressure plate 6 and rear body 12.

Adapter ring 5 is provided within pump element receiving portion 112 which is a cylindrical portion. Adapter ring 5 is an annular member including a cam ring receiving portion 54 (receiving space) formed in an inside space of adapter ring 5. Adapter ring 5 is not limited to the ring shape as long as adapter ring 5 has at least an arc portion so that the receiving space is formed in the inside space of adapter ring 5. Adapter ring 5 may be formed into a C-shape. A radial through hole 51 is formed at a y-axis positive side end portion of adapter ring 5. A plug member insertion hole 114 is formed at a y-axis positive side end portion of front body 11. A plug member 73 having a bottomed cup shape is inserted into plug member insertion hole 114 so as to ensure the liquid-tightness between front body 11 and the outside. A cam spring 201 is inserted radially inside this plug member 73 so as to expand and contract in the y-axis direction. Cam spring 201 penetrates through radial through hole 51 of adapter ring 5, and abuts on cam ring 4. Cam spring 201 urges cam ring 4 in the negative direction of the y-axis. Cam spring 201 urges cam ring 4 in a direction in which a swing amount of cam ring 4 is maximized so as to stabilize the discharge amount (the swing position of the cam ring) at a start of the operation of the pump at which the pressure is not stabilized.

Cam ring receiving portion 54 is formed on the inside of adapter ring 5. Cam ring 4 is provided within this cam ring receiving portion 54 so as to be movable with respect to drive shaft 2. Cam ring 4, rotor 3, and vanes 32 form a plurality of pump chambers 13. This cam ring 4 is movably provided within cam ring receiving portion 54 of adapter ring 5. This cam ring 4 is an annular member having an axial length shorter than an axial length of adapter ring 5.

A pin 40*a* is provided between adapter ring 5 and cam ring 4. This pin 40*a* restricts the rotation of adapter ring 5 within front body 11 at the drive of the pump. Moreover, cam ring 4 is arranged to be swung on a support plate 40 in the y-axis direction.

A seal member 50 is provided at a z-axis positive side end portion of an adapter ring inner circumference surface 53. A support surface N is formed at a z-axis negative side end portion of adapter ring inner circumference surface 53. A support plate 40 is provided on support surface N. Support plate 40 and seal member 50 separate a first fluid pressure chamber A1 and a second fluid pressure chamber A2 between cam ring 4 and adapter ring 5. This first fluid pressure chamber A1 is formed within cam ring receiving portion 54, on the outer circumference side of cam ring 4. First fluid pressure chamber A1 is formed on a side on which an internal volume is decreased when cam ring 4 is moved in a direction in which the volumes of the plurality of pump chambers 13 are increased. The second fluid pressure chamber A2 is formed within cam ring receiving portion 54, on the outer circumference side of the cam ring 4. The second fluid pressure chamber A2 is formed on a side on which an internal volume is increased when cam ring 4 is moved in the direction in which the plurality of the pump chambers 13 are increased.

Adapter ring 5 includes a through hole 52 formed at a portion on a z-axis positive side of adapter ring 5, on a y-axis negative side of the seal member 50. This through hole 52 is connected to a spool 70 through a control pressure hydraulic passage 113 provided in front body 11, so as to connect first fluid pressure chamber A1 on the y-axis negative side and the spool 70.

(Structure of Front Body)

Front body 11 includes a shaft supporting portion (rotatably supporting portion) 117 rotatably supporting drive shaft 2. This shaft supporting portion 117 is formed in bottom portion 111 to penetrate through bottom portion 111. An oil seal 2*a* is provided at an end portion of shaft supporting portion 117 which is on the pulley 9's side. Oil seal 2*a* ensures the liquid-tightness within the vane pump. Front body 11 includes a control valve receiving hole 116, a control valve suction hydraulic passage 115, and control pressure hydraulic passage 113 which are located on the z-axis positive side. Control valve receiving hole 116 receives a spool 70 which is a pressure control means (member) arranged to control the eccentric amount of cam ring 4 by controlling the pressure within first fluid pressure chamber A1. Control valve suction hydraulic passage 115 is arranged to introduce the hydraulic fluid from suction passage IN to spool 70. Control pressure hydraulic passage 113 is arranged to discharge the control pressure to first fluid pressure chamber A1.

Moreover, bottom portion 111 includes a suction groove 111*b* recessed and formed at a position to confront a second suction opening 62 of pressure plate 6 described later; a discharge groove 111*a* recessed and formed at a position to confront a second discharge opening 63; and a discharge pressure introduction groove 111*c* confronting a side surface of the x-axis negative side of a suction side back pressure groove 64; and a discharge passage 20 connected to discharge groove 111*a*, and arranged to discharge the hydraulic fluid to the power steering apparatus. The suction pressure is acted to suction groove 111*b*. The discharge pressure is acted to discharge groove 111*a* and discharge pressure introduction groove 111*c*. A lubrication hydraulic passage 118 is formed obliquely with respect to the x-axis to be connected to suction groove 111*b* so as to supply the lubricating oil to oil seal 2*a*.

(Structure of Pressure Plate)

Pressure plate 6 is provided within pump element receiving portion 112 which is the cylindrical portion. Pressure plate 6 is disposed between adapter ring 5 and bottom portion 111. Moreover, pressure plate 6 includes an x-axis positive side surface 61 which is an abutment portion that is abutted on a side surface of adapter ring 5 on one side of the axial direction; and a through hole 66 that is a hole portion through which drive shaft 2 passes, and which is relatively moved in the axial direction with respect to drive shaft 2.

X-axis positive side surface 61 of pressure plate 6 includes second suction opening 62 formed into an arc shape, and disposed on the z-axis positive side; second discharge opening 63 formed into an arc shape, and disposed on the z-axis negative side; and a suction side back pressure groove 64 and a discharge side back pressure groove 65 arranged to introduce the discharge pressure to back pressure chambers 33. Second suction opening 62 is disposed to confront an one axial end surface of cam ring 4 (a left side of FIG. 1). Second suction opening 62 is opened to the suction region in which the volumes of the plurality of pump chambers 13 are increased in accordance with the rotation of drive shaft 2.

Moreover, pressure plate 6 includes an x-axis negative side surface 67 on which the discharge pressure of discharge groove 111*a* and discharge pressure introduction groove 111*c* is acted. Pressure plate 6 is arranged to be urged toward cam ring 5 by the pressure acted to the x-axis negative direction side surface 67.

(Structure of Rear Body)

Rear body 12 includes a suction passage 12*a* which extends in the z-axis direction, and which is arranged to introduce the hydraulic fluid from reservoir tank RES storing the hydraulic fluid, to a first suction opening 122. A hydraulic passage 12*d* is formed at a portion on the z-axis positive side of suction passage 12*a*. Hydraulic passage 12*d* is arranged to supply the hydraulic pressure to spool 70. Rear body 12 includes a shaft supporting portion (rotatably supporting portion) 12*c* which is located at a substantially central portion of rear body 12, which includes a bottom, and which rotatably supports drive shaft 2. A lubrication hydraulic passage 12*b* is formed at a lower end of suction passage 12*a*. Lubrication hydraulic passage 12*b* is connected with shaft supporting portion 12*c* so as to ensure the lubrication for the slide movement of drive shaft 2 with respect to shaft supporting portion 12*c*.

Rear body 12 includes a pump forming surface 120 which is located on the x-axis negative side, and which is raised into a circular shape. In a case where the pressure plate 6's side of cam ring 4 is defined as the other end side of cam ring 4, this pump forming surface 120 is positioned on one end side of cam ring 4. Pump forming surface 120 includes first suction opening 122 disposed to confront the one axial end surface of cam ring 4 (on the right side in FIG. 1), and opened in the suction region. Moreover, pump forming surface 120 includes a first discharge opening 123 disposed to confront the one axial end surface of cam ring 4, and opened in the discharge region. Furthermore, pump forming surface 120 includes a suction side back pressure groove 124 and a discharge side back pressure groove 125 arranged to introduce the discharge pressure to back pressure chambers 33.

Figure 3:
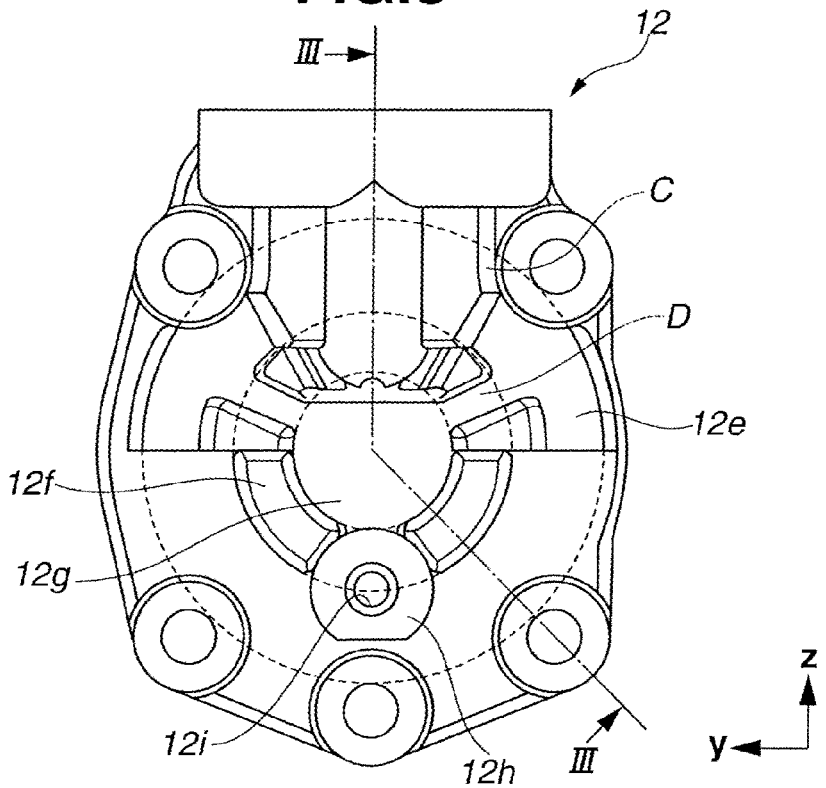
FIG. 3 is a front view showing a rear body of the variable displacement vane pump of FIG. 1.
Figure 4:
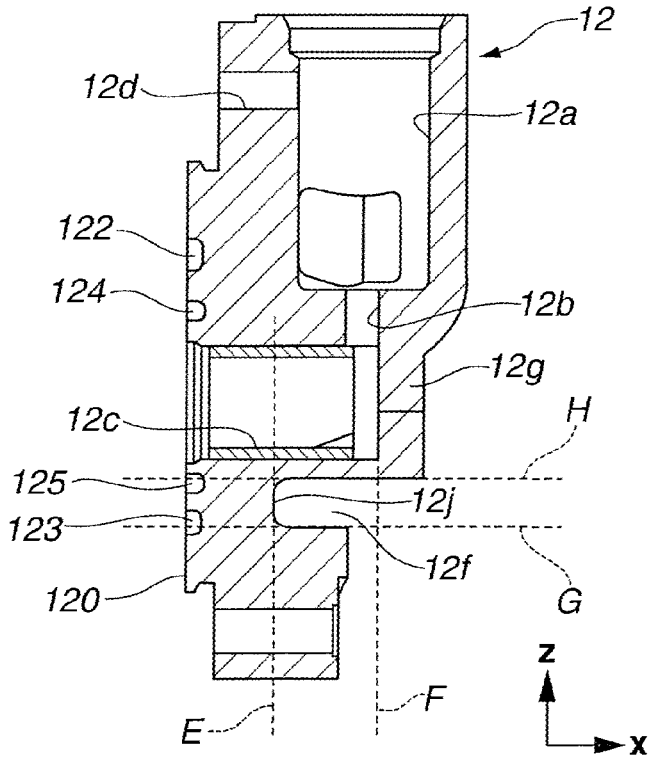
FIG. 4 is an axial sectional view which shows the rear body of the variable displacement vane pump of FIG. 1, and which is taken along a section line III-III of FIG. 3.
Figure 5:
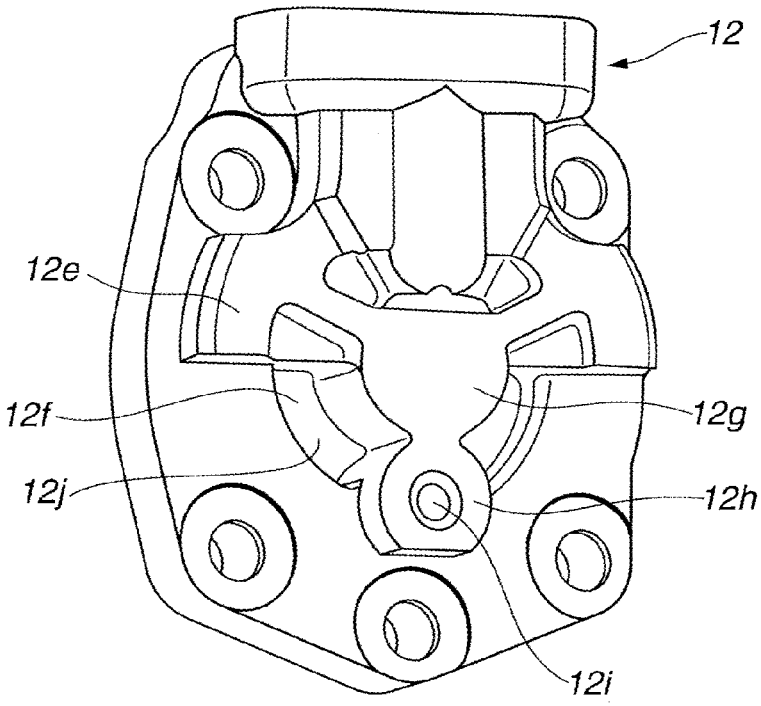
FIG. 5 is a perspective view showing the rear body of the variable displacement vane pump of FIG. 1.
Figure 6:
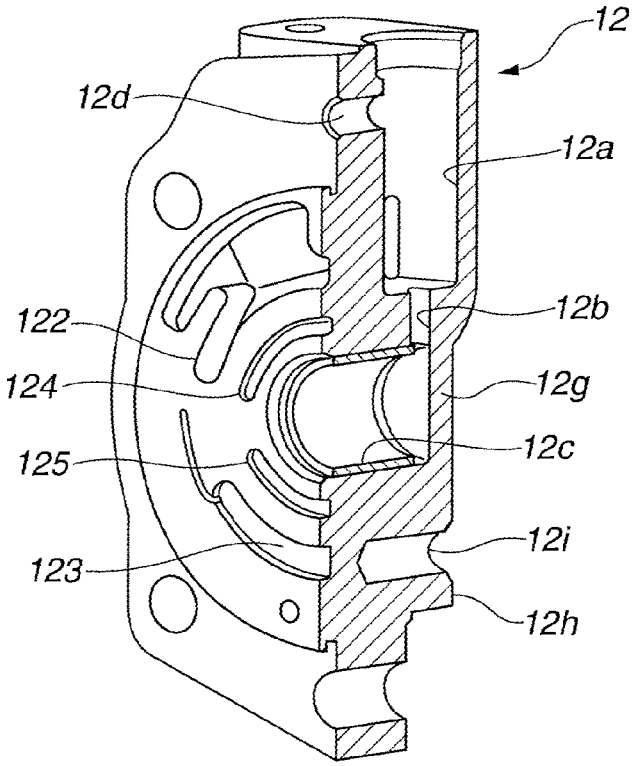
FIG. 6 is a perspective view showing the rear body of the variable displacement vane pump of FIG. 1.

FIG. 3 is a view when rear body 12 is viewed from the x-axis positive direction. FIG. 4 is an axial sectional view of rear body 12 (a sectional view taken along a section line III-III of FIG. 3). FIG. 5 is a perspective view showing rear body 12. FIG. 6 is a perspective view when rear body 12 is cut by a surface passing through an axis of suction passage 12*a* and an axis of shaft supporting portion 12*c*.

Rear body 12 includes a thick wall portion 12*e* which is formed in a region corresponding to the suction region in a region (a region C shown in FIG. 3) in which rear body 12 is overlapped with cam ring 4 when rear body 12 is viewed from the y-axis negative direction, and which has a thickness in the x-axis direction which is larger than those of the other portions. Moreover, rear body 12 includes a shaft supporting raised portion (rotatably supporting raised portion) 12*g* which is located at a position to correspond to shaft supporting portion 12*c*, and which has a raised shape that is continuous with shaft supporting raised portion 12*g*; and a bolt boss 12*h* which is located on the z-axis negative side of shaft supporting raised portion 12*g*, and which has a raised shape that is continuous with shaft supporting raised portion 12*g*. Bolt boss portion 12*h* includes a screw portion 12*i* into which a bolt is inserted when pump body 10 is fixed to the vehicle.

Rear body 12 includes a thin wall portion 12*f* which is located in a region (except for bolt boss 12*h*) corresponding to the discharge region in the region (a region D shown in FIG. 3) in which rear body 12 is overlapped with rotor 3 when rear body 12 is viewed from the y-axis negative direction side, and which has a recessed shape.

An x-axis position of bottom surface 12*j* of this thin wall portion 12*f* (a position of a dot line E shown in FIG. 4), is positioned on the front body 11's side (the x-axis negative side) relative to an x-axis position of the bottom surface of shaft supporting portion 12*c* (a position of a dot line F shown in FIG. 4). A thickness between bottom surface 12*j* and pump forming surface 120 on the x-axis negative side of rear body 12 is thinnest (smallest) of the x-axis thicknesses of rear body 12.

This thin wall portion 12*f* is formed in the circumferential direction approximately over half of the circumference. Bolt boss 12*h* is formed at a substantially circumferential middle portion of this thin wall portion 12*f*. That is, thin wall portions 12*f* are formed at two positions. Each of thin wall portions 12*f* has a shape having a circumferential length longer than a radial length (a width of the recessed shape).

A position of a radially outer side of bottom surface 12*j* of thin wall portion 12*f* (position of a dot line G shown in FIG. 4) is formed to be overlapped with first discharge opening 123 formed in pump forming surface 120 on the x-axis negative side of the rear body 12. Furthermore, a position of a radially inner side of bottom surface 12*j* of thin wall portion 12*f* (position of a dot line H shown in FIG. 4) is formed to be overlapped with discharge side back pressure groove 125 formed in pump forming surface 120 on the x-axis negative side of rear body 12.

Structure of Control Section

A control section of variable displacement vane pump 1 includes first fluid pressure chamber A1, second fluid pressure chamber A2, a control valve 7, and discharge passage 20.

Discharge passage 20 is a passage of the hydraulic fluid which connects various portions within pump body 10. Front body 11 includes control valve receiving hole 116 which has a substantially cylindrical shape extending in the y-axis direction. Control valve 7 is received within control valve receiving hole 116.

Control valve 7 is arranged to switch the supply of the hydraulic fluid to first fluid pressure chamber A1 by moving (displacing) the position of spool 70. In the state of FIG. 2, control pressure hydraulic passage 113 is connected with a low pressure chamber 116*b* described later. The suction pressure is acted to first fluid pressure chamber A1.

A valve spring 71 is disposed in a compressed state on the y-axis positive side of spool 70. Valve spring 71 constantly urges spool 70 in the y-axis negative direction. A cover member 72 is screwed on the y-axis negative side of spool 70. Cover member 72 closes the opening portion of control valve receiving hole 116.

Spool 70 includes a first small diameter portion 70*a*, a first land portion 70*b*, a second small diameter portion 70*c*, and a second land portion 70*d* arranged in this order from the y-axis negative side. Each of first land portion 70*b* and second land portion 70*d* has an outside diameter substantially identical to an inside diameter of control valve receiving hole 116. Moreover, each of first small diameter portion 70*a* and second small diameter portion 70*c* has an outside diameter smaller than the inside diameter of control valve receiving hole 116. Control valve receiving hole 116 includes a high pressure chamber 116*a* which is formed within control valve receiving hole 116, and which is a space surrounded by an inner circumference of control valve receiving hole 116, an outer circumference of first small diameter portion 70*a*, cover member 72, and first land portion 70*b*. Moreover, control valve receiving hole 116 includes a low pressure chamber 116*b* which is formed within control valve receiving hole 116, and which is a space surrounded by the inner circumference of control valve receiving hole 116, an outer circumference of second small diameter portion 70*c*, first land portion 70*b*, and second land portion 70*d*. Furthermore, control valve receiving hole 116 includes a middle pressure chamber 116*c* which is formed within control valve receiving hole 116, and which is a space surrounded by the inner circumference and the y-axis positive side surface of control valve receiving hole 116, and second land portion 70*d*.

High pressure chamber 116*a* and middle pressure chamber 116*c* are connected with discharge passage 20. Discharge passage 20 is connected with discharge groove 111*a*. Discharge passage 20 is bifurcated into a passage 21 and a passage 22. Passage 22 is connected with high pressure chamber 116*a*. Passage 21 is connected with middle pressure chamber 116*c*. A metering orifice 23 is provided in the middle of passage 21. Metering orifice 23 is arranged to increase a pressure difference between the front side and the rear side (the upstream side and the downstream side) of metering orifice 23 as the discharge flow rate (flow amount) of variable displacement vane pump 1 is increased. That is, the hydraulic pressure of middle pressure chamber 116*c* becomes lower with respect to the hydraulic pressure of high pressure chamber 116*a* as the discharge pressure is increased.

Spool 70 includes a relief valve receiving hole 70*e* which is formed within spool 70, and which includes an opening on the y-axis positive side. A relief valve 8 is received within relief valve receiving hole 70*e*. Relief valve 8 is arranged to connect middle pressure chamber 116*c* and low pressure chamber 116*b* when the hydraulic pressure of middle pressure chamber 116*c* is extremely increased. In this relief valve 8, a valve spring 80, a spring holding member 81, a ball plug 82, and a seat member 83 are provided in this order from the y-axis negative side. Seat member 83 includes a through hole 83*a* penetrating through seat member 83 in the axial direction. Seat member 83 is press-fit in relief valve receiving hole 70*e*. Valve spring 80 is provided in a compressed state between spring holding member 81, and the bottom surface of relief valve receiving hole 70*e* on the y-axis negative side. Valve spring 80 urges ball plug 82 toward seat member 83 through spring holding member 81. Spool 70 includes a through hole 70*f* which is located near ball plug 82, and which penetrates relief valve receiving hole 70*e* and the outer circumference of second small diameter portion 70*c*. That is, the portion of relief valve receiving hole 70*e* on the y-axis negative side of ball plug 82 is connected with low pressure chamber 116*b*.

Function (Supply of Hydraulic Fluid to First and Second Fluid Pressure Chambers)

Next, the function of the supply of the hydraulic fluid is illustrated.

Passage 22 is connected with high pressure chamber 116*a* of control valve receiving hole 116. Passage 21 is connected with middle pressure chamber 116*b* of control valve receiving hole 116. By metering orifice 23 provided in the middle of passage 21, the pressure difference between the front side and the rear side (the upstream side and the downstream side) of metering orifice 23 becomes larger as the discharge flow rate of the variable displacement vane pump 1 becomes larger. That is, the hydraulic pressure of middle pressure chamber 116*c* becomes lower with respect to the hydraulic pressure of high pressure chamber 116*a* as the discharge flow rate is increased. In this case, the position of spool 70 is controlled by this pressure difference and the urging force of valve spring 71 provided on the y-axis positive side of spool 70, so that the control pressure is generated.

In particular, when the discharge flow rate of variable displacement vane pump 1 is small and the pressure difference between the front side and the rear side (the upstream side and the downstream side) of the metering orifice 23 is small, the pressure difference between the hydraulic pressure of high pressure chamber 116*a* and hydraulic pressure of the middle pressure chamber 116*c* is small. Accordingly, the urging force in the y-axis positive direction which is received by spool 70 from the hydraulic pressure within the high pressure chamber 116*a* is smaller than the urging force in the y-axis negative direction which is received by spool 70 from the hydraulic pressure within middle pressure chamber 116*c* and valve spring 71. Consequently, spool 70 is moved in the y-axis negative direction (spool 70 is positioned at the position shown in FIG. 2). In this case, first fluid passage A1 is connected with low pressure chamber 116*b*, so that the suction pressure is introduced into first fluid passage A1 as the control pressure.

When the discharge flow rate of variable displacement vane pump 1 is increased, the pressure difference between the front side and the rear side (the upstream side and the downstream side) of metering orifice 23 becomes larger in accordance with the increase of the discharge flow rate. With this, when the urging force in the y-axis positive direction which is received by spool 70 from the hydraulic pressure within high pressure chamber 116*a* becomes greater than the urging force in the y-axis negative direction which is received by spool 70 from the hydraulic pressure within middle pressure chamber 116*c* and valve spring 71, spool 70 is started to be moved in the y-axis positive direction. When spool 70 is moved in the y-axis positive direction, the opening area of control pressure hydraulic passage 113 opened to low pressure chamber 116*b* is gradually decreased by first land portion 70*b*. Conversely, the opening area of control pressure hydraulic passage 113 opened to high pressure chamber 116*a* is gradually increased. Finally, the connection between low pressure chamber 116*b* and control pressure hydraulic passage 113 is shut off (closed), and high pressure chamber 116*a* and control pressure hydraulic passage 113 are connected with each other. In this case, the suction pressure is introduced into first fluid pressure chamber A1 as the control pressure. Besides, when control pressure hydraulic passage 113 is opened to both of high pressure chamber 116*a* and low pressure chamber 116*b*, the pressure regulated in accordance with the opening ratios of control pressure hydraulic passage 113 to high pressure chamber 116*a* and low pressure chamber 116*b* is introduced into first fluid pressure chamber A1 as the control pressure.

As described above, the control pressure according to the position of spool 70 is introduced into first fluid pressure chamber A1. On the other hand, second fluid pressure chamber A2 is connected with second suction opening 62 and first suction opening 122, so that the suction pressure is introduced into second fluid pressure chamber A2. Accordingly, the suction pressure is constantly introduced into second fluid pressure chamber A2. With this, in variable displacement vane pump 1, the only hydraulic pressure P1 of first fluid pressure chamber A1 is controlled. Hydraulic pressure P2 of second fluid pressure chamber A2 is not controlled, so that hydraulic pressure P2 of second fluid pressure chamber A2 is equal to the suction pressure (the hydraulic pressure P2=the suction pressure). Consequently, second fluid pressure chamber A2 can obtain the stable pressure. Therefore, it is possible to prevent the disturbance of the hydraulic pressure, and to perform the stable swing control of the cam ring 4.

(Eccentric Movement of Cam Ring)

When the urging force in the y-axis positive direction which is received by cam ring 4 from the hydraulic pressure P1 of the first fluid pressure chamber A1 becomes greater than the summation of the urging forces in the y-axis negative direction which is received by cam ring 4 from the hydraulic pressure P2 of the second fluid pressure chamber A2 and cam spring 201, cam ring 4 is rolled on support plate 40 and moved in the y-axis positive direction. By this movement of cam ring 4, the volumes of pump chambers 13 on the y-axis positive side are increased, and the volumes of pump chambers 13 on the y-axis negative side are decreased.

When the volumes of pump chambers 13 on the y-axis negative side are decreased, an amount of the hydraulic fluid per unit time which is supplied from the suction side to the discharge side is decreased, so that the pressure difference between the upstream side pressure and the downstream side pressure of metering orifice 23 is decreased. With this, spool 70 is pressed and returned by valve spring 71, so that the control pressure of spool 70 is decreased. Accordingly, hydraulic pressure P1 of first fluid pressure chamber A1 is decreased. Cam ring 4 is moved in the y-axis negative direction when cam ring 4 does not resist the summation of the urging force in the y-axis negative direction.

When the urging forces in the y-axis positive direction and in the y-axis negative direction become substantially equal to each other, the forces in the y-axis direction which are acted to cam ring 4 are balanced, so that cam ring 4 is stopped. With this, when the pressure difference of metering orifice 23 is increased when the amount of the hydraulic fluid is increased, spool 70 presses valve spring 71, so that the valve control pressure is increased. Therefore, cam ring 4 is moved in the y-axis positive direction contrary to the above-described case. In fact, cam ring 4 does not generate the movement hunting, and the eccentric amount of cam ring 4 is determined so that the flow rate set by the orifice diameter of metering orifice 23 and valve spring 71 becomes constant.

(Uniformalization of Change of Shape of Rear Body)

Conventionally, the thicknesses of the appearance on the x-axis positive side and the x-axis negative side of rear body 12 are substantially uniformalized even in the portion corresponding to the suction region and in the portion corresponding to the discharge region. Suction passage 12*a* is formed in the portion of the rear body 12 which corresponds to the suction region. On the other hand, the portion of the rear body 12 which corresponds to the discharge region is formed into the solid state (tight state). Accordingly, the suction region side of rear body 12 has a rigidity lower than that of the discharge region of rear body 12.

Even in the suction region, pressure plate 6 is pressed in the x-axis positive direction by the discharge pressure introduced into discharge pressure introduction groove 111*c* formed in bottom portion 111 of front body 11. Moreover, the discharge pressure is acted to suction side back pressure groove 64, back pressure chambers 33 of rotor 3 which are positioned in the suction region, and suction side back pressure groove 124 of rear body 12. Accordingly, the stress is concentrated on the suction region side of rear body 12 which has the low rigidity. Consequently, the change of the shape of rear body 12 on the suction region side may become larger relative to that of rear body 12 on the discharge region side. Therefore, the amount of the change of the shape of the suction region of pump forming surface 120 of rear body 12 in the x-axis positive direction may become larger, relative to the discharge region of pump forming surface 120 of rear body 12. Consequently, rotor 3 and the discharge region of pump forming surface 120 become partial contact (misaligned abutment) (rotor 3 and pump forming surface 120 are abutted in the tilt state), so that the galling may be generated.

Variable displacement vane pump 1 according to the first embodiment includes thin wall portion 12*f* which is formed on the surface of rear body 12 on the x-axis positive side, and which is the recessed shape opened toward the x-axis positive side. Thin wall portion 12*f* is formed so that the thickness between bottom surface 12*j* of thin wall portion 12*f* and pump forming surface 120 on the x-axis negative side of rear body 12 becomes smallest in the x-axis direction thicknesses of rear body 12.

With this, it is possible to decrease the rigidity of the discharge region side of rear body 12, and thereby to change the shape of the discharge region side of rear body 12 by the amount substantially identical to that of the suction region side when variable displacement vane pump 1 is driven. Accordingly, it is possible to suppress the partial contact of rotor 3 and pump forming surface 120.

Moreover, in variable displacement vane pump 1 according to the first embodiment, the radially outer portion of the outer edge of thin wall portion 12*f* of rear body 12 is formed to be overlapped with first discharge opening in the radial direction (as viewed in the axial direction).

With this, it is possible to decrease the rigidity of the discharge region side of rear body 12, relative to a case where thin wall portion 12*f* is formed so that the radially outer portion of the outer edge of thin wall portion 12*f* is positioned radially inside first discharge opening 123.

Accordingly, it is possible to suppress the partial contact of rotor 3 and pump forming surface 120. Moreover, in this embodiment, it is possible to increase the rigidity of the portion of first discharge opening 123 of rear body 12, relative to a case where thin wall portion 12*f* is formed so that the radially outer portion of the outer edge of thin wall portion 12*f* is positioned radially outside first discharge opening 123. Accordingly, it is possible to increase the amount of the change of the shape from the radially middle portion of first discharge opening 123 to the radially inside portion of first discharge opening 123, and to suppress the partial contact between rotor 3 and the radially inside portion of the opening outer edge of first discharge opening 123.

Moreover, in variable displacement vane pump 1 according to the first embodiment, the radially outer portion of the outer edge of bottom portion 12*j* of thin wall portion 12*f* of rear body 12 is formed to be overlapped with first discharge opening 123 in the radial direction (as viewed in the axial direction).

Bottom surface 12*j* is a portion having a thinnest thickness in the x-axis direction in rear body 12. By defining the position relationship between the outer edge of bottom surface 12*j* and first discharge opening 12, it is possible to accurately adjust the rigidity of the discharge region of rear body 12.

Moreover, in variable displacement vane pump 1 according to the first embodiment, the radially inner portion of the outer edge of thin wall portion 12*f* is formed to be overlapped with discharge side back pressure groove 125 in the radial direction (as viewed in the axial direction).

With this, it is possible to ensure appropriate balance of the rigidity of rear body 12 near discharge side back pressure groove 125, and to suppress the partial contact between rotor 3 and the radially outer portion of the outer edge of discharge side back pressure groove 125.

Moreover, in variable displacement vane pump 1, the thickness in the x-axis direction (the x-axis direction thickness) of the discharge region of rear body 12 is smaller than the thickness in the x-axis direction of the suction region of rear body 12, in the region where rear body 12 is overlapped with cam ring 4 in the radial direction.

With this, it is possible to decrease the rigidity of the discharge region side of rear body 12 even in a portion radially outside thin wall portion 12*f*, and to improve the balance of the rigidity of the suction region side of rear body 12 and the rigidity of the discharge region side of rear body 12.

Moreover, in variable displacement vane pump 1 according to the first embodiment, thin wall portion 12*f* of rear body 12 is formed so that bottom surface 12*j* is positioned on the front body 11's side of the bottom surface of shaft supporting portion 12*c* (at an axial position between front body 11 and the bottom surface of shaft supporting portion 12*c*).

With this, it is possible to sufficiently decrease the thickness of rear body 12 in thin wall portion 12*f*, and to decrease the rigidity. Accordingly, it is possible to improve the balance between the rigidity of the suction region of rear body 12 and the rigidity of the discharge region of rear body 12.

Moreover, in variable displacement vane pump 1 according to the first embodiment, bolt boss 12*h* is formed at a circumferential middle portion of thin wall portion 12*f* of rear body 12. The bolt is inserted into bolt boss 12*h* from the outside of rear body 12.

In a case where thin wall portion 12*f* has the long circumferential length, the deflection of the circumferential middle portion of thin wall portion 12*f* becomes large. In this embodiment, bolt boss 12*h* is formed at the circumferential middle portion of thin wall portion 12*f*. With this, it is possible to suppress local deflection of thin wall portion 12*f*.

Furthermore, in variable displacement vane pump 1 according to the first embodiment, thin wall portion 12*f* of rear body 12 has an elongated thin arc shape having the circumferential length longer than the radial length.

With this, it is possible to act the function of the decrease of the rigidity by the thin-wall portion 12*f*, more widely, uniformly in the discharge region.

(1) The variable displacement pump includes the pump body 10 (the pump housing) including the front body 11 (the first housing) including the pump element receiving portion 112 (the cylindrical portion), and the bottom portion 111 closing the x-axis negative side (the one axial side) of the pump element receiving portion 112, and the rear body 12 (the second housing) closing the x-axis positive side (the other axial side) of the pump element receiving portion 112; the drive shaft 2 rotatably supported by the pump body 10; the annular cam ring 4 movably provided within the pump element receiving portion 112 of the pump body 10; the rotor 3 provided within the cam ring 4, and driven and rotated by the drive shaft 2; the plurality of slits 31 formed in the rotor 3 in the circumferential direction; the vanes 32 each of which is provided within one of slits 31 to be moved into and out of the one of the slits 31, and which separate the plurality of pump chambers with the cam ring 4 and the rotor 3; the pressure plate 6 provided within the pump element receiving portion 112, and pressed toward the cam ring 4 by the discharge pressure discharged from the pump chambers 13; the first suction opening 122 (the suction opening) formed in the rear body 12, and formed at a position to confront the suction region in which the volumes of the plurality of the pump chambers 13 are increased in accordance with the rotation of the rotor 3; the suction passage 12*a* formed in the rear body 12, and arranged to introduce the hydraulic fluid from the outside of the pump body 10 to the first suction opening 122; the first discharge opening 123 and the second discharge opening 63 (the discharge opening) formed in one of the pressure plate 6 and the rear body 12, and formed at a position to confront the discharge region in which the volumes of the plurality of the pump chambers 13 are decreased in accordance with the rotation of the rotor 3; the discharge passage 20 formed in the pump body 10, and arranged to discharge the discharge hydraulic fluid which is the hydraulic fluid discharged from the discharge region, to the outside of the pump body 10; the suction side back pressure groove 124 and the discharge side back pressure groove 125 (the back pressure introduction groove) which is formed in the rear body 12, which has an arc shape to confront the back pressure chambers 33 (the slit base end portion) which are the radially innermost ends of the slits 31, which is formed at least on the suction region side, and which is arranged to protrude the vanes 32 in the radially outside direction by receiving a part of the discharge hydraulic fluid; and the thin wall portion 12*f* (the discharge side thin wall portion) which is formed in the rear body 12, which has the recessed shape opened to the outside, which is disposed in the discharge region side, which is overlapped with the rotor 3 in the radial direction, and which includes a smallest thickness portion having a smallest wall thickness of thicknesses each of which is an axial length between a bottom surface 12*j* of the recessed shape and an axially inner side surface of the rear body 12, the smallest wall thickness being a smallest wall thickness of axial thicknesses of the rear body 12.

Accordingly, it is possible to decrease the rigidity of the discharge region side of rear body 12, and to change the shape of the discharge region side of rear body 12 by the amount substantially identical to the amount of the suction region side. Consequently, it is possible to suppress the partial contact of rotor 3 and pump forming surface 120, and to suppress the generation of the galling.

(2) The thin wall portion 12*f* includes a radially outer portion of an outer edge which is formed to overlapped with the first discharge opening 123 in the radial direction.

Accordingly, it is possible to decrease the rigidity of the discharge region side of rear body 12, relative to a case in which thin wall portion 12*f* is formed so that the radially outer portion of the outer edge of thin wall portion 12*f* is radially inside first discharge opening 123. Therefore, it is possible to suppress the partial contact between rotor 3 and pump forming surface 120, and to suppress the generation of the galling.

Moreover, it is possible to increase the rigidity of the portion of first discharge opening 123 of rear body 12 relative to a case in which thin wall portion 12*f* is formed so that the radially outer portion of the outer edge of thin wall portion 12*f* is positioned radially outside first discharge opening 123. Accordingly, it is possible to increase the amount of the change of the shape from the radially middle portion of first discharge opening 123 to the radially inner side portion of first discharge opening 123. Consequently, it is possible to suppress the partial contact between the radially inner portion of the opening outer edge of first discharge opening 123 and rotor 3, and to suppress the generation of the galling.

(3) Discharge side back pressure groove 125 is formed on the discharge region side. The radially inner portion of the outer edge of thin wall portion 12*f* is formed to be overlapped with discharge side back pressure groove 125 on the discharge region side in the radial direction.

Accordingly, it is possible to ensure appropriate balance of the rigidity of rear body 12 near discharge side back pressure groove 125, to suppress the partial contact between rotor 3 and the radially outer portion of the outer edge of discharge side back pressure groove 125, and to suppress the generation of the galling.

(4) The variable displacement vane pump includes the pump body 10 (the pump housing) including the front body 11 (the first housing) including a pump element receiving portion 112 (the cylindrical portion), and the bottom portion 111 closing an x-axis negative side (the one axial side) of the pump element receiving portion 112, and the rear body 12 (the second housing) closing an x-axis positive side (the axial other side) of the pump element receiving portion 112; the drive shaft 2 rotatably supported by the pump body 10; the annular cam ring 4 movably provided within the pump element receiving portion 112 of the pump body 10; the rotor 3 provided within the cam ring 4, and driven and rotated by the drive shaft 2; the plurality of slits 31 formed in the rotor 3 in the circumferential direction; vanes 32 each of which is provided within one of the slits 31 to be moved into and out of the one of the slits 31, and which separates the plurality of pump chambers 13 with the cam ring 4 and the rotor 3; the pressure plate 6 provided within the pump element receiving portion 112 between the bottom portion 111 and the cam ring 4, and pressed toward the cam ring 4 by the discharge pressure discharged from the pump chambers 13; the first suction opening 122 (the suction opening) formed in the rear body 12, and formed at a position to confront the suction region in which the volumes of the pump chambers 13 are increased in accordance with the rotation of the rotor 3; the suction passage 12*a* formed in the rear body 12, and arranged to introduce the hydraulic fluid from the outside of the pump body 10 to the first suction opening 122; the first discharge opening 123 and the second discharge opening 63 (the discharge opening) which are formed, respectively, in the pressure plate 6 and the rear body 12, and each of which is formed at a position to confront the discharge region in which the volumes of the plurality of the pump chambers 13 are decreased in accordance with the rotation of the rotor 3; the discharge passage 20 which is formed in the pump body 10, and which is arranged to discharge the discharge hydraulic fluid which is the hydraulic fluid discharged from the discharge region, to the outside of the pump body 10; the suction side back pressure groove 124 and the discharge side back pressure groove 125 (the back pressure introduction groove) which is formed in the rear body 12, which has an arc shape to confront the back pressure chambers 33 (the base end portions of the slits) which are the radially innermost ends of the slits 31, which is formed at least in the suction region side, and which is arranged to protrude the vanes 32 in the radially outer direction by receiving a part of the discharge hydraulic fluid; and the thin wall portion 12*f* which is formed in the rear body 12, which has a recessed shape opened to the outside, which is disposed in the discharge region side, and which is radially overlapped with a region between the discharge side back pressure introduction groove 125 and the first discharge opening 123, the recessed shape of the thin wall portion 12*f* having a substantially arc shape having a circumferential length longer than a radial length.

Accordingly, it is possible to decrease the rigidity of the discharge region side of rear body 12, and to vary the shape of the discharge region side by the amount substantially identical to that of the suction region side when variable displacement vane pump 1 is driven. Consequently, it is possible to suppress the partial contact between rotor 3 and pump forming surface 120, and to suppress the generation of the galling.

(5) The variable displacement pump includes the pump body 10 (the pump housing) including the front body (the first housing) including the pump element receiving portion 112 (the cylindrical portion), and the bottom portion 111 closing the x-axis negative side (the one axial side) of the pump element receiving portion 112, and the rear body 12 (the second housing) closing the x-axis positive side (the other axial side) of the pump element receiving portion 112; the shaft supporting portion 117 (the first shaft insertion hole) formed in the front body 11; the shaft supporting portion 12*c* (the second shaft insertion hole) which is formed in the rear body 12, and which includes the opening opened toward the front body 11, and the bottom portion; the drive shaft 2 rotatably supported within the shaft supporting portion 117 and the shaft supporting portion 12*c*; the annular cam ring 4 movably provided within the pump element receiving portion 112; the rotor 3 provided within the cam ring 4, and driven and rotated by the drive shaft 2; the plurality of slits 31 formed in the rotor 3 in the circumferential direction; the vanes 32 each of which is provided in one of the slits 31 to be moved into and out of the one of the slits 31, and which separates the plurality of pump chambers 13 with the cam ring 4 and the rotor 3; the pressure plate 6 provided within the pump element receiving portion 112 between the bottom portion 111 and the cam ring 4, and pressed toward the cam ring 4 by the discharge pressure discharged from the pump chambers 13; the first suction opening 122 (the suction opening) formed in the rear body 12, and formed at a position to confront the suction region in which the volumes of the plurality of the pump chambers 13 are increased in accordance with the rotation of the rotor 3; the suction passage 12*a* formed in the rear body 12, and arranged to introduce the hydraulic fluid from the outside of the pump body 10 to the first suction opening 122; the first discharge opening 123 (the discharge opening) formed in the rear body 12, and formed at a position to confront the discharge region in which the volumes of the plurality of the pump chambers 13 are decreased in accordance with the rotation of the rotor 3; the discharge passage 20 formed in the pump body 10, and arranged to discharge the discharge hydraulic fluid which is the hydraulic fluid discharged from the discharge region, to the outside of the pump body 10; the suction side back pressure groove 124 and the discharge side back pressure groove 125 (the back pressure introduction groove) which are formed in the rear body 12, each of which has an arc shape to confront the back pressure chambers 33 (the slit base end portions) which are the radially innermost end portions of the slits 31, and which are formed on the suction region side and the discharge region side, and which is arranged to protrude the vanes 32 in the radially outward direction by receiving a part of the discharge hydraulic fluid; and the thin wall portion 12*f* which is formed in the rear body 12, which has a recessed shape opened to the outside, which is disposed on the discharge region side, and which is radially overlapped with a region between the discharge side back pressure introduction groove 125 and the first discharge opening 123, and which includes a smallest thickness portion that has a smallest wall thickness of thicknesses each of which is an axial length between a bottom surface 12*j* of the recessed shape and an axially inner side surface of the rear body 12, and that includes a bottom surface positioned between the first housing and a bottom surface of the second shaft insertion hole.

Accordingly, it is possible to decrease the rigidity of the discharge region side of the rear body 12, and to vary the shape of the discharge region side by the amount of the change of the shape which is substantially identical to that of the suction region side when variable displacement vane pump 1 is driven. Consequently, it is possible to suppress the partial contact between rotor 3 and pump forming surface 120, and to suppress the generation of the galling.

Second Embodiment

Figure 7:
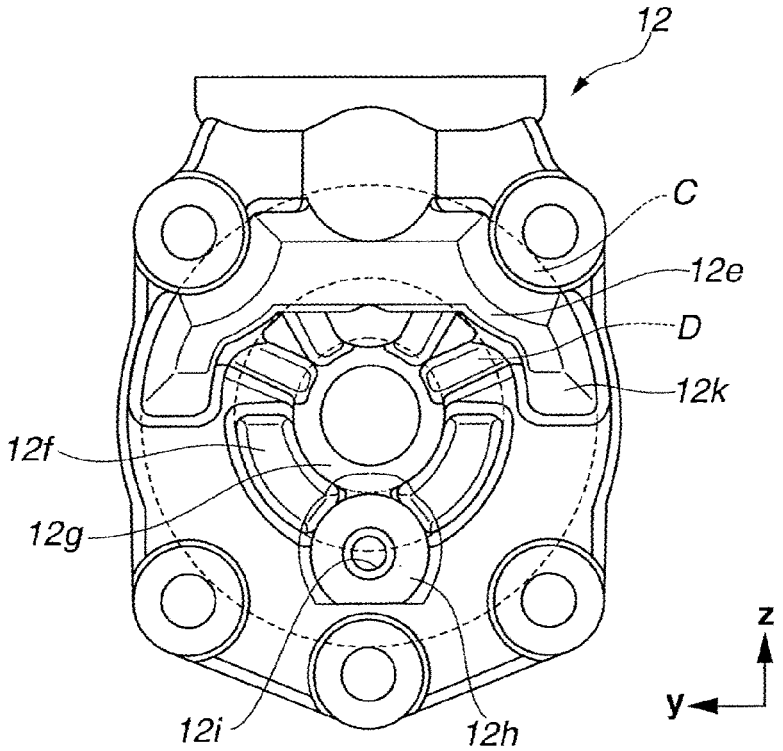
FIG. 7 is a front view showing a rear body of a variable displacement vane pump according to a second embodiment of the present invention.
Figure 8:
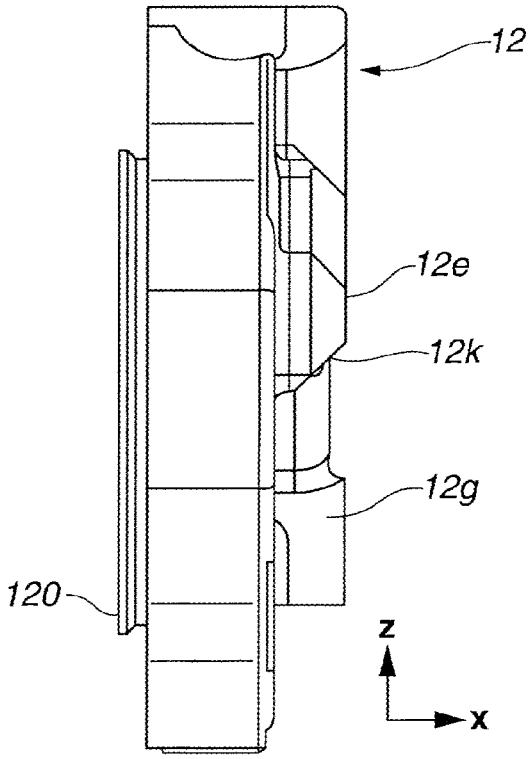
FIG. 8 is a side view showing the rear body of the variable displacement vane pump of FIG. 7.

Hereinafter, a variable displacement vane pump 1 according to a second embodiment of the present invention is illustrated. In variable displacement vane pump 1 according to the second embodiment, taper portions 12*k* are formed at circumferential end portions of thick wall portion 12*e* of rear body 12. The variable displacement vane pump according to the second embodiment is substantially identical to the pump according to the first embodiment in most aspects shown by the use of the same reference numerals. Accordingly, the same illustrations are omitted. FIG. 7 is a view when rear body 12 is viewed from the x-axis positive side. FIG. 8 is a view when rear body 12 is viewed from the y-axis positive side.

As shown in FIGS. 7 and 8, taper portions 12*k* are formed at the circumferential end portions of thick wall portion 12*e*. Each of taper portions 12*k* has a thickness gradually increased from the discharge region side to the suction region side. That is, taper portions 12*k* whose the axial thicknesses of rear body 12 are gradually increased toward the suction region side are formed in the middle portion between the discharge region side and the suction region side, in the overlap region of rear body 12 in which rear body 12 is overlapped with cam ring 4 in the radial direction (in the axial direction).

(6) The taper portion 12*k* is formed in the middle portion between the discharge region side and the suction region side in the region of the rear body 12 in which the rear body 12 is overlapped with the cam ring 4 in the radial direction. In the taper portion 12*k*, the thickness of the rear body 12 is gradually increased toward the suction region side.

Accordingly, it is possible to smooth the variation of the thickness of rear body 12 in the middle portion between the discharge region side and the suction region side, and to relieve the concentration of the stress.

Other Embodiments

No Bolts

Figure 9:
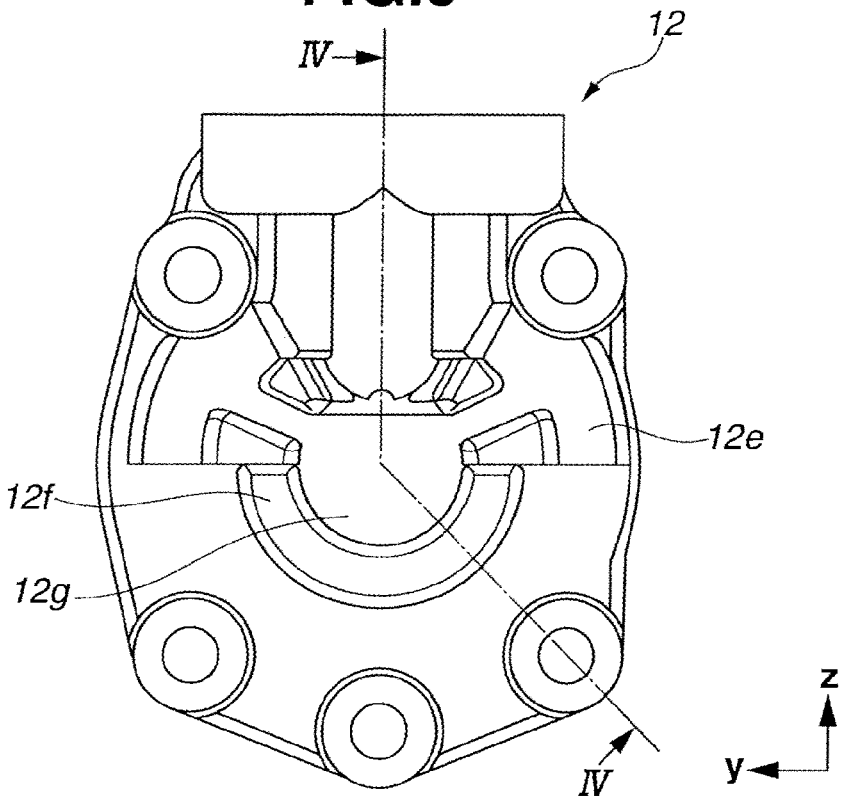
FIG. 9 is a front view showing a rear body of a variable displacement vane pump according to a first variation of the embodiments of the present invention.
Figure 10:
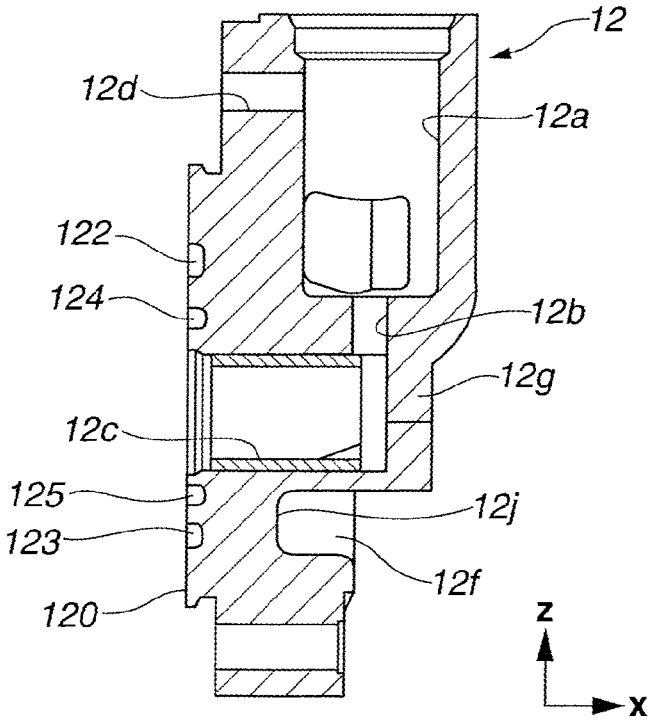
FIG. 10 is an axial sectional view which shows the rear body of FIG. 9, and which is taken along a section line IV-IV of FIG. 9.
Figure 11:
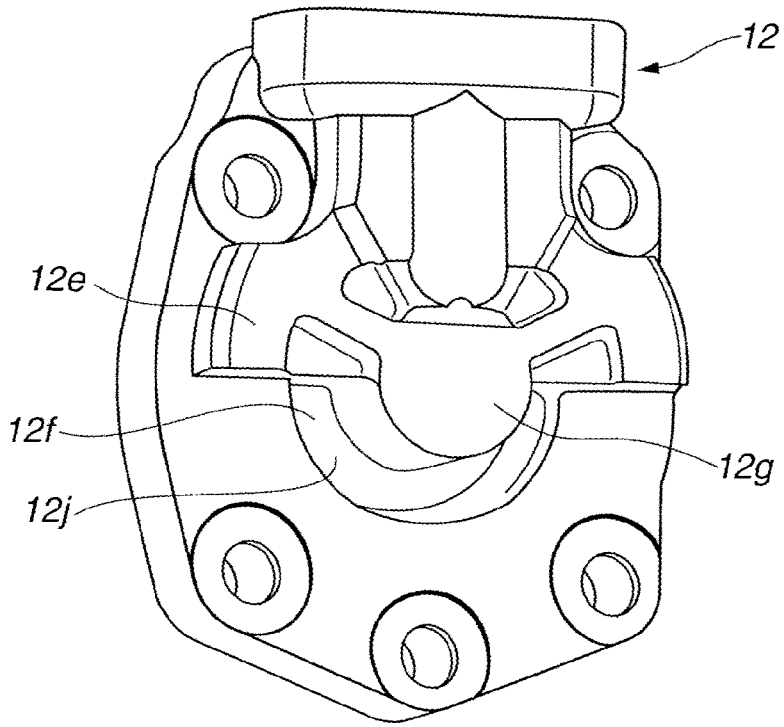
FIG. 11 is a perspective view showing the rear body of FIG. 9.
Figure 12:
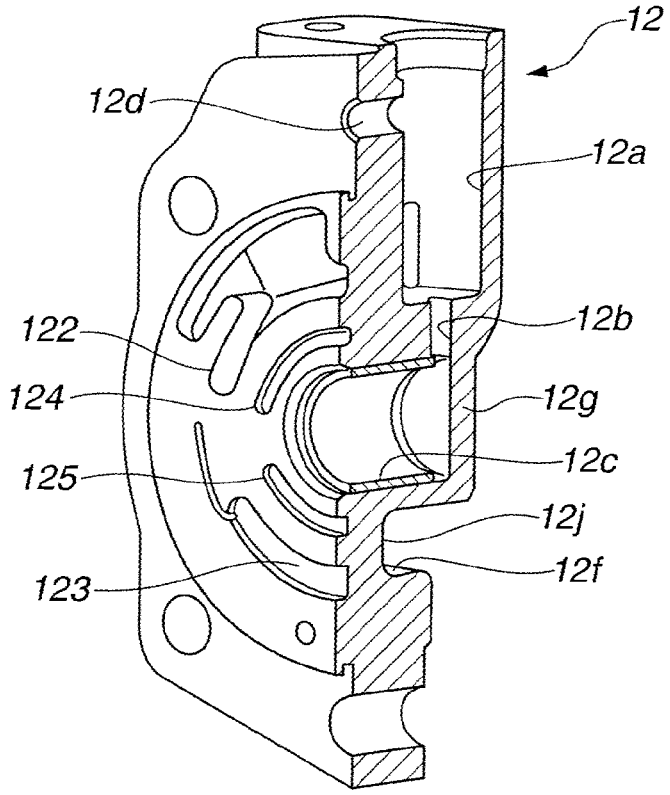
FIG. 12 is a perspective view showing the rear body of FIG. 9.

FIG. 9 is a view when rear body 12 is viewed from the x-axis positive side. FIG. 10 is an axial sectional view of rear body 12 (a sectional view taken along a section line IV-IV of FIG. 9). FIG. 11 is a perspective view showing rear body 12. FIG. 12 is a perspective view showing a state where rear body 12 is cut by a surface passing through the axis of suction passage 12*a* and the axis of the shaft supporting portion 12*c*.

As shown in FIGS. 9-12, the bolt boss may be not provided. Thin wall portion 12*f* may be formed in the discharge region approximately over half of the circumference.

Another Shape 1 of Thin Wall Portion

Figure 13:
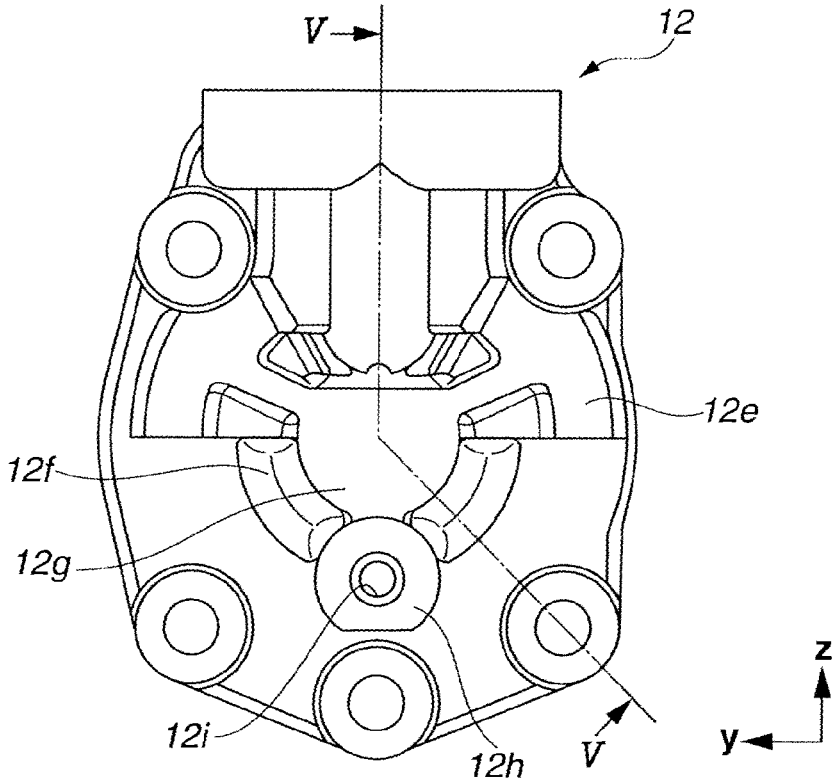
FIG. 13 is a front view showing a rear body of a variable displacement vane pump according to a second variation of the embodiments of the present invention.
Figure 14:
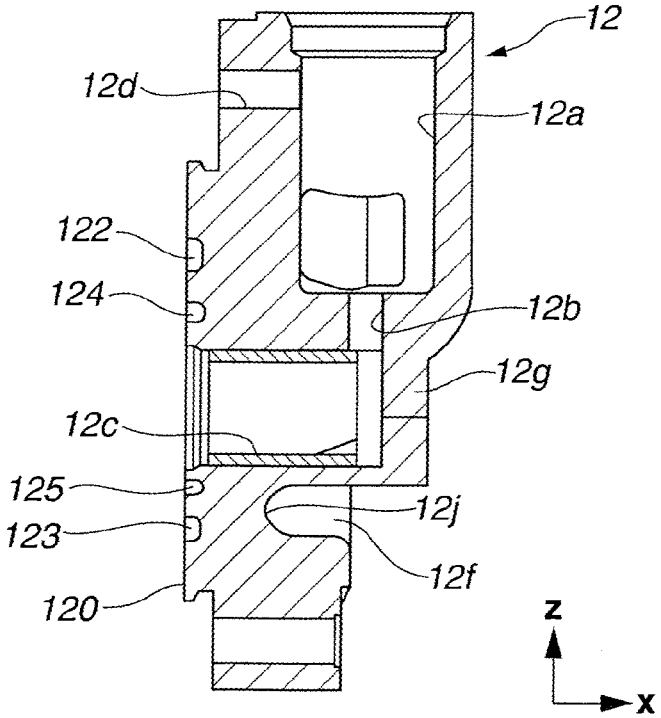
FIG. 14 is an axial sectional view which shows the rear body of FIG. 13, and which is taken along a section line V-V of FIG. 13.

FIG. 13 is a view when rear body 12 is viewed from the x-axis positive direction. FIG. 14 is an axial sectional view of rear body 12 (a sectional view taken along a section line V-V of FIG. 13).

As shown in FIGS. 13 and 14, the radial sectional shape of bottom surface 12*j* of thin wall portion 12*f* may be formed into a curved shape.

Another Shape 2 of Thin Wall Portion

Figure 15:
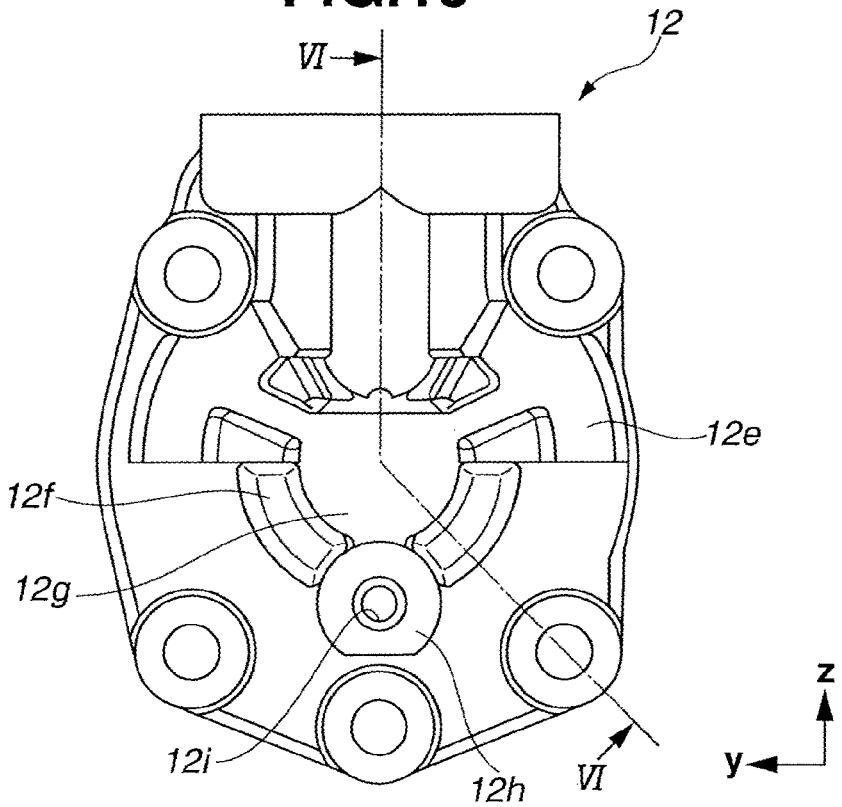
FIG. 15 is a front view showing a rear body of a variable displacement vane pump according to a third variation of the embodiments of the present invention.
Figure 16:
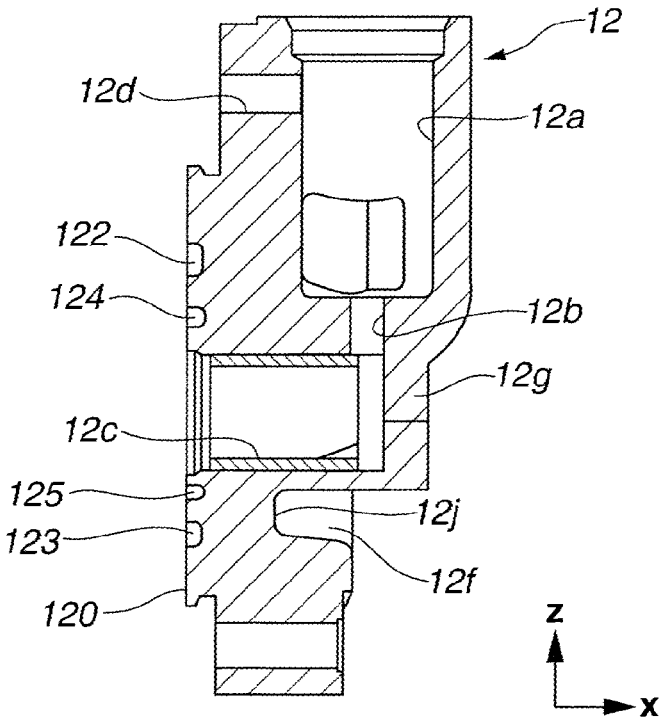
FIG. 16 is an axial sectional view which shows the rear body of FIG. 15, and which is taken along a section line VI-VI of FIG. 15.

FIG. 15 is a view when rear body 12 is viewed from the x-axis positive direction. FIG. 16 is an axial sectional view of rear body 12 (a sectional view taken along a section line VI-VI of FIG. 15).

As shown in FIGS. 15 and 16, the surface on the radially outer side of thin wall portion 12*f* may be inclined toward the outside.

Another Shape 3 of Thin Wall Portion

Figure 17:
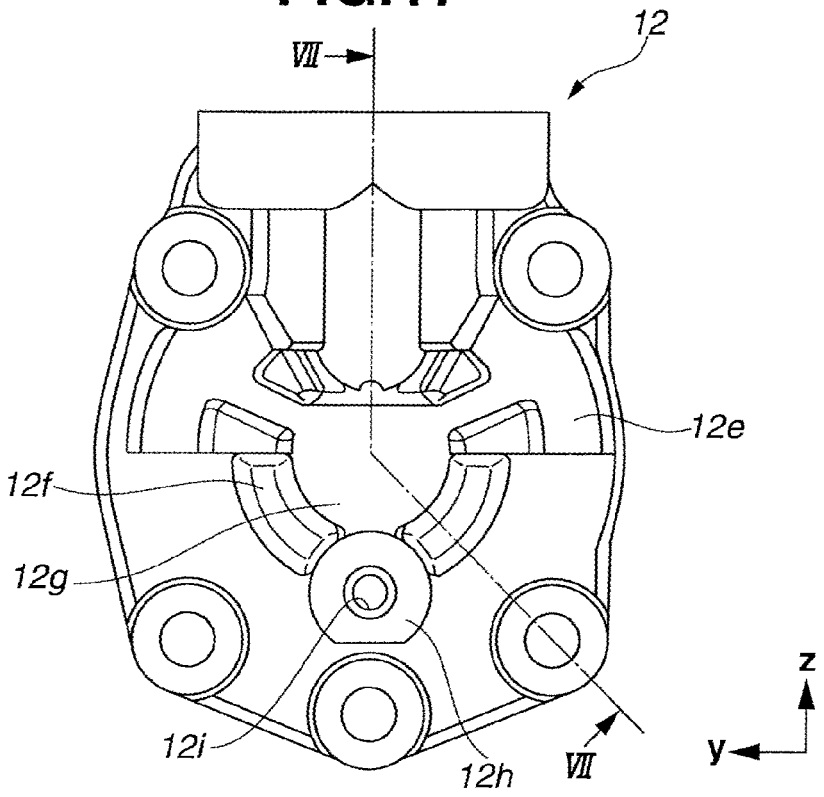
FIG. 17 is a front view showing a rear body of a variable displacement vane pump according to a fourth variation of the embodiments of the present invention.
Figure 18:
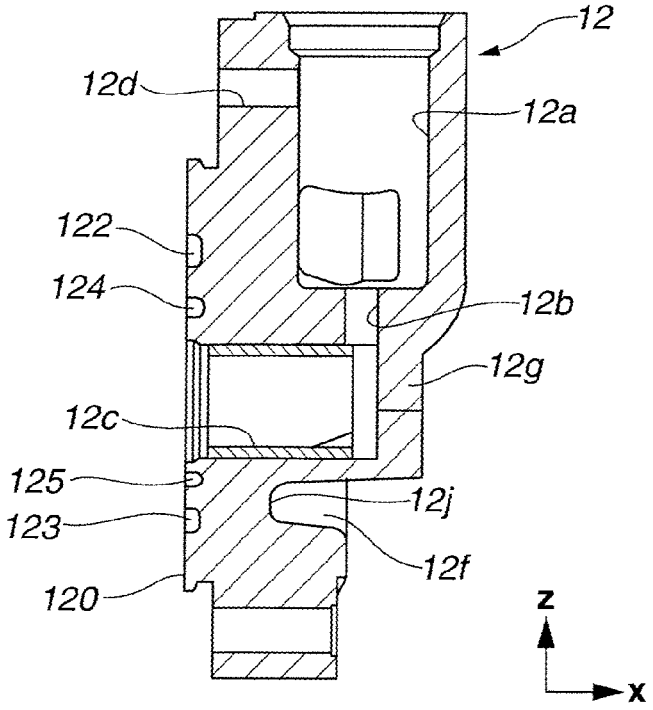
FIG. 18 is an axial sectional view which shows the rear body of FIG. 17, and which is taken along a section line VII-VII of FIG. 17.

FIG. 17 is a view when rear body 12 is viewed from the x-axis positive side. FIG. 18 is an axial sectional view of rear body 12 (a sectional view taken along a section line VII-VII of FIG. 18).

As shown in FIGS. 17 and 18, thin wall portion 12*f* may include a draft angle formed in the side surface of thin wall portion 12*f*.

(A) The outer edge of the discharge side thin wall portion is an outer edge of the bottom surface of the discharge side thin wall portion.

The bottom portion has a smallest axial thickness of the axial thicknesses of the second housing. By defining the position relationship between the outer edge of the bottom surface and the discharge opening, it is possible to accurately adjust the rigidity of the second housing on the discharge region.

(B) The second housing has an axial thickness in the discharge region side which is smaller than an axial thickness in the suction region side, in an overlap region in which the second housing is overlapped with the cam ring in the radial direction.

Accordingly, it is possible to decrease the rigidity of the discharge region of the second housing even in the portion radially outside the discharge side thin wall portion, and thereby to improve the balance between the rigidity of the suction region side of the second housing and the rigidity of the discharge region side of the second housing.

(C) The second housing includes a taper portion which is located in the overlap region in which the second housing is overlapped with the cam ring in the radial direction, which is located at a middle portion between the discharge region side and the suction region side, and in which an axial thickness of the second housing is gradually increased toward the suction region.

Accordingly, it is possible to smooth the variation of the thickness of rear body 12 in the middle portion between the discharge region side and the suction region side, and to relieve the concentration of the stress.

(D) The first housing includes a first shaft insertion hole which rotatably supports the drive shaft; the second housing includes a second shaft insertion hole which includes an opening that is on a first side of the second shaft insertion hole, and that is opened toward the first housing, and a bottom portion that is on a second side of the second shaft insertion hole, and which rotatably supports the drive shaft; and the bottom surface of the discharge side thin wall portion is formed at an axial position between the first housing and the bottom surface of the second shaft insertion hole).

Accordingly, it is possible to sufficiently decrease the thickness of the second housing in the discharge side thin wall portion, and to decrease the rigidity. Consequently, it is possible to improve the balance between the rigidity of the suction region side of the second housing and the rigidity of the discharge region side of the second housing.

(E) The second housing includes a bolt boss which is located at a substantially middle portion of the discharge side thin wall portion in the circumferential direction, and into which the bolt is inserted from the outside of the second housing.

In a case where thin wall portion 12*f* is elongated in the circumferential direction, the deflection (flexure) amount of thin wall portion 12*f* becomes larger. By forming bolt boss 12*h* in the circumferential middle portion of thin wall portion 12*f*, it is possible to suppress the local deflection (flexure) of thin wall portion 12*f*.

(F) The discharge side thin wall portion has a substantially thin elongated arc shape which has an circumferential length longer than a radial length.

Accordingly, it is possible to act the function of the decrease of the rigidity by the discharge side thin wall portion, more widely, uniformly in the discharge region side.

(G) The discharge side thin wall portion includes a radially outer portion of an outer edge which is formed to overlapped with the discharge opening in the radial direction.

Accordingly, it is possible to decrease the rigidity of the discharge region side of the second housing, relative to a case where the thin wall portion is formed so that the radially outside portion of the outer edge of the discharge side thin wall portion is positioned radially inside the discharge opening. Consequently, it is possible to suppress the partial contact between the rotor and the second housing, and to suppress the generation of the galling.

Moreover, it is possible to increase the rigidity of the portion of the discharge opening portion of the second housing, relative to a case where the discharge side thin wall portion is formed so that the radially outside portion of the outer edge of the discharge side thin wall portion is positioned radially outside the discharge opening. Consequently, it is possible to increase the amount of the variation of the shape from the radially middle portion of the discharge opening to the radially inner side portion of the discharge opening. Moreover, it is possible to suppress the partial contact between the rotor and the radially inside portion of the opening outer edge of the discharge opening, and to suppress the generation of the galling.

(H) The back pressure introduction groove is a first back pressure introduction groove; the variable displacement pump further includes a second back pressure introduction groove which is the back pressure introduction groove formed in the discharge region side; and the discharge side thin wall portion includes a radially inner side portion of an outer edge which is overlapped with the second back pressure introduction groove on the discharge region side in the radial direction.

Accordingly, it is possible to ensure the proper balance of the rigidity of the second housing near the back pressure introduction groove on the discharge region side, to suppress the partial contact between the radially outside portion of the outer edge of the back pressure introduction groove and the rotor, and to suppress the generation of the galling.

(I) The second housing has an axial thickness in the discharge region side which is smaller than an axial thickness in the suction region side, in an overlap region in which the second housing is overlapped with the cam ring in the radial direction.

Accordingly, it is possible to decrease the rigidity of the discharge region side of the second housing in a portion radially outside the discharge side thin wall portion, and to improve the balance between the rigidity of the suction region side of the second housing and the rigidity of the discharge region side of the second housing.

(J) The second housing includes a taper portion which is located in the overlap region in which the second housing is overlapped with the cam ring in the radial direction, which is located at a middle portion between the discharge region side and the suction region side, and in which an axial thickness of the second housing is gradually increased toward the suction region.

Accordingly, it is possible to smooth the variation of the thickness of the rear body 12 in the middle portion between the discharge region side and the suction region side, and thereby to relieve the concentration of the stress.

(K) The first housing includes a first shaft insertion hole which rotatably supports the drive shaft; the second housing includes a second shaft insertion hole which includes an opening that is on a first side of the second shaft insertion hole, and that is opened toward the first housing, and a bottom portion that is on a second side of the second shaft insertion hole, and which rotatably supports the drive shaft; and the bottom surface of the discharge side thin wall portion is formed at an axial position between the first housing and the bottom surface of the second shaft insertion hole).

Accordingly, it is possible to sufficiently decrease the wall thickness of the second housing in the discharge side thin wall portion, and thereby to decrease the rigidity. Consequently, it is possible to improve the balance between the rigidity of the suction region side of the second housing and the discharge region side of the second housing.

(L) The discharge side thin wall portion includes a radially outer portion of an outer edge which is formed to overlapped with the discharge opening in the radial direction.

Accordingly, it is possible to decrease the rigidity of the discharge region side of the second housing, relative to a case where the thin wall portion is formed so that the radially outside portion of the outer edge of the discharge side thin wall portion is positioned radially inside the discharge opening. Consequently, it is possible to suppress the partial contact between the rotor and the second housing, and to suppress the generation of the galling.

Moreover, it is possible to increase the rigidity of the portion of the discharge opening portion of the second housing, relative to a case where the discharge side thin wall portion is formed so that the radially outside portion of the outer edge of the discharge side thin wall portion is positioned radially outside the discharge opening. Consequently, it is possible to increase the amount of the variation of the shape of the portion from the radially middle portion of the discharge opening to the radially inside portion of the discharge opening, to suppress the partial contact between the rotor and the radially inner portion of the opening outer edge of the discharge opening, and to suppress the generation of the galling.

(M) The back pressure introduction groove is a first back pressure introduction groove; the variable displacement pump further includes a second back pressure introduction groove which is the back pressure introduction groove formed in the discharge region side; and the discharge side thin wall portion includes a radially inner side portion of an outer edge which is overlapped with the second back pressure introduction groove on the discharge region side in the radial direction.

Accordingly, it is possible to ensure the proper balance of the rigidity of the second housing near the back pressure introduction groove on the discharge region side, to suppress the partial contact between the rotor and the radially outside portion of the outer edge of the back pressure groove, and to suppress the generation of the galling.

(N) The second housing has an axial thickness in the discharge region side which is smaller than an axial thickness in the suction region side, in an overlap region in which the second housing is overlapped with the cam ring in the radial direction.

Accordingly, it is possible to decrease the rigidity of the discharge region side of the second housing even in the portion radially outside the discharge side thin wall portion, and to improve the balance between the rigidity of the suction region side of the second housing and the rigidity of the discharge region side of the second housing.

(O) The second housing includes a taper portion which is located in the overlap region in which the second housing is overlapped with the cam ring in the radial direction, which is located at a middle portion between the discharge region side and the suction region side, and in which an axial thickness of the second housing is gradually increased toward the suction region.

Accordingly, it is possible to smooth the variation of the thickness of rear body 12 in the middle portion between the discharge region side and the suction region side, and to relieve the concentration of the stress.

The entire contents of Japanese Patent Application No. 2012-065598 filed Mar. 22, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump comprising:

a pump housing including a first housing including a cylindrical portion, and a bottom portion closing one axial side of the cylindrical portion, and a second housing closing the other axial side of the cylindrical portion;

a drive shaft rotatably supported by the pump housing;

an annular cam ring movably provided within the cylindrical portion of the first housing;

a rotor provided within the cam ring, and driven and rotated by the drive shaft;

a plurality of slits formed in the rotor in a circumferential direction;

a plurality of vanes each of which is provided within one of the slits to be moved into and out of the one of the slits, and which separate a plurality of pump chambers with the cam ring and the rotor;

a pressure plate provided within the cylindrical portion of the first housing between the bottom portion of the first housing and the cam ring, and pressed toward the cam ring by a discharge pressure discharged from the pump chambers;

a suction opening formed in the second housing, and formed at a position to confront a suction region in which volumes of the plurality of pump chambers are increased in accordance with the rotation of the rotor;

a suction passage formed in the second housing, and arranged to introduce a hydraulic fluid from an outside of the pump housing to the suction opening;

a discharge opening formed in one of the pressure plate and the second housing, and formed at a position to confront a discharge region in which the volumes of the plurality of the pump chambers are decreased in accordance with the rotation of the rotor;

a discharge passage formed in the pump housing, and arranged to discharge a discharge hydraulic fluid which is the hydraulic fluid discharged from the discharge region, to the outside of the pump housing;

a back pressure introduction groove which is formed in the second housing, which has an arc shape to confront base end portions of the slits that are radially innermost ends of the slits, which is formed at least on the suction region side, and which is arranged to protrude the vanes in the radially outside direction by receiving a part of the discharge hydraulic fluid; and a discharge side thin wall portion which is formed in the second housing, which has a recessed shape opened to the outside, which is disposed on the discharge region side, which is overlapped with the rotor in the radial direction, and which includes a smallest thickness portion having a smallest wall thickness of thicknesses each of which is an axial length between a bottom surface of the recessed shape and an axially inner side surface of the second housing, the smallest wall thickness being a smallest wall thickness of axial thicknesses of the second housing.

2. The variable displacement pump as claimed in claim 1, wherein the discharge side thin wall portion includes a radially outer portion of an outer edge which is formed to overlapped with the discharge opening in the radial direction.

3. The variable displacement pump as claimed in claim 1, wherein the back pressure introduction groove is a first back pressure introduction groove; the variable displacement pump further comprises a second back pressure introduction groove which is the back pressure introduction groove formed in the discharge region side; and the discharge side thin wall portion includes a radially inner side portion of an outer edge which is overlapped with the second back pressure introduction groove on the discharge region side in the radial direction.

4. The variable displacement pump as claimed in claim 2, wherein the outer edge of the discharge side thin wall portion is an outer edge of the bottom surface of the discharge side thin wall portion.

5. The variable displacement pump as claimed in claim 2, wherein the second housing has an axial thickness in the discharge region side which is smaller than an axial thickness in the suction region side, in an overlap region in which the second housing is overlapped with the cam ring in the radial direction.

6. The variable displacement pump as claimed in claim 5, wherein the second housing includes a taper portion which is located in the overlap region in which the second housing is overlapped with the cam ring in the radial direction, which is located at a middle portion between the discharge region side and the suction region side, and in which an axial thickness of the second housing is gradually increased toward the suction region.

7. The variable displacement pump as claimed in claim 1, wherein the first housing includes a first shaft insertion hole which rotatably supports the drive shaft; the second housing includes a second shaft insertion hole which includes an opening that is on a first side of the second shaft insertion hole, and that is opened toward the first housing, and a bottom portion that is on a second side of the second shaft insertion hole, and which rotatably supports the drive shaft; and the bottom surface of the discharge side thin wall portion is formed at an axial position between the first housing and the bottom surface of the second shaft insertion hole.

8. The variable displacement pump as claimed in claim 1, wherein the second housing includes a bolt boss which is located at a substantially middle portion of the discharge side thin wall portion in the circumferential direction, and into which the bolt is inserted from the outside of the second housing.

9. The variable displacement pump as claimed in claim 1, wherein the discharge side thin wall portion has a substantially thin elongated arc shape which has an circumferential length longer than a radial length.

10. A variable displacement pump comprising:

a pump housing including a first housing including a cylindrical portion, and a bottom portion closing one axial side of the cylindrical portion, and a second housing closing the other axial side of the cylindrical portion;

a drive shaft rotatably supported by the pump housing;

an annular cam ring movably provided within the cylindrical portion of the first housing;

a rotor provided within the cam ring, and driven and rotated by the drive shaft;

a plurality of slits formed in the rotor in a circumferential direction;

a plurality of vanes each of which is provided within one of the slits to be moved into and out of the one of the slits, and which separate a plurality of pump chambers with the cam ring and the rotor;

a pressure plate provided within the cylindrical portion of the first housing between the bottom portion of the first housing and the cam ring, and pressed toward the cam ring by a discharge pressure discharged from the pump chambers;

a suction opening formed in the second housing, and formed at a position to confront a suction region in which volumes of the plurality of pump chambers are increased in accordance with the rotation of the rotor;

a suction passage formed in the second housing, and arranged to introduce a hydraulic fluid from an outside of the pump housing to the suction opening;

a discharge opening formed in the second housing, and formed at a position to confront a discharge region in which the volumes of the plurality of the pump chambers are decreased in accordance with the rotation of the rotor;

a discharge passage formed in the pump housing, and arranged to discharge a discharge hydraulic fluid which is the hydraulic fluid discharged from the discharge region, to the outside of the pump housing;

a back pressure introduction groove which is formed in the second housing, which has an arc shape to confront base end portions of the slits that are radially innermost ends of the slits, which is formed on the suction region side and the discharge region side, and which is arranged to protrude the vanes in the radially outer direction by receiving a part of the discharge hydraulic fluid; and a discharge side thin wall portion which is formed in the second housing, which has a recessed shape opened to the outside, which is disposed on the discharge region side, and which is radially overlapped with a region between the back pressure introduction groove and the discharge opening, the recessed shape of the discharge side thin wall portion having a substantially arc shape having a circumferential length longer than a radial length.

11. The variable displacement pump as claimed in claim 10, wherein the discharge side thin wall portion includes a radially outer portion of an outer edge which is formed to overlapped with the discharge opening in the radial direction.

12. The variable displacement pump as claimed in claim 10, wherein the back pressure introduction groove is a first back pressure introduction groove; the variable displacement pump further comprises a second back pressure introduction groove which is the back pressure introduction groove formed in the discharge region side; and the discharge side thin wall portion includes a radially inner side portion of an outer edge which is overlapped with the second back pressure introduction groove on the discharge region side in the radial direction.

13. The variable displacement pump as claimed in claim 10, wherein the second housing has an axial thickness in the discharge region side which is smaller than an axial thickness in the suction region side, in an overlap region in which the second housing is overlapped with the cam ring in the radial direction.

14. The variable displacement pump as claimed in claim 13, wherein the second housing includes a taper portion which is located in the overlap region in which the second housing is overlapped with the cam ring in the radial direction, which is located at a middle portion between the discharge region side and the suction region side, and in which an axial thickness of the second housing is gradually increased toward the suction region.

15. The variable displacement pump as claimed in claim 10, wherein the first housing includes a first shaft insertion hole which rotatably supports the drive shaft; the second housing includes a second shaft insertion hole which includes an opening that is on a first side of the second shaft insertion hole, and that is opened toward the first housing, and a bottom portion that is on a second side of the second shaft insertion hole, and which rotatably supports the drive shaft; and the bottom surface of the discharge side thin wall portion is formed at an axial position between the first housing and the bottom surface of the second shaft insertion hole.

16. A variable displacement pump comprising:

a pump housing including a first housing including a cylindrical portion, and a bottom portion closing one axial side of the cylindrical portion, and a second housing closing the other axial side of the cylindrical portion;

a first shaft insertion hole formed in the first housing;

a second shaft insertion hole which is formed in the second housing, and which including an opening opened toward the first housing, and a bottom portion;

a drive shaft rotatably supported within the first shaft insertion hole and the second shaft insertion hole;

an annular cam ring movably provided within the cylindrical portion;

an annular cam ring movably provided within the is cylindrical portion of the first housing;

a rotor provided within the cam ring, and driven and rotated by the drive shaft;

a plurality of slits formed in the rotor in a circumferential direction;

a plurality of vanes each of which is provided within one of the slits to be moved into and out of the one of the slits, and which separate a plurality of pump chambers with the cam ring and the rotor;

a pressure plate provided within the cylindrical portion of the first housing between the bottom portion of the first housing and the cam ring, and pressed toward the cam ring by a discharge pressure discharged from the pump chambers;

a suction opening formed in the second housing, and formed at a position to confront a suction region in which volumes of the plurality of pump chambers are increased in accordance with the rotation of the rotor;

a suction passage formed in the second housing, and arranged to introduce a hydraulic fluid from an outside of the pump housing to the suction opening;

a discharge opening formed in the second housing, and formed at a position to confront a discharge region in which the volumes of the plurality of the pump chambers are decreased in accordance with the rotation of the rotor;

a discharge passage formed in the pump housing, and arranged to discharge a discharge hydraulic fluid which is the hydraulic fluid discharged from the discharge region, to the outside of the pump housing;

a back pressure introduction groove which is formed in the second housing, which has an arc shape to confront base end portions of the slits that are radially innermost ends of the slits, which is formed on the suction region side and the discharge region side, and which is arranged to protrude the vanes in the radially outside direction by receiving a part of the discharge hydraulic fluid; and a discharge side thin wall portion which is formed in the second housing, which has a recessed shape opened to the outside, which is disposed on the discharge region side, which is radially overlapped with a region between the back pressure introduction groove and the discharge opening, and which includes a smallest thickness portion that has a smallest wall thickness of thicknesses each of which is an axial length between a bottom surface of the recessed shape and an axially inner side surface of the second housing, and that includes a bottom surface positioned between the first housing and a bottom surface of the second shaft insertion hole.

17. The variable displacement pump as claimed in claim 16, wherein the discharge side thin wall portion includes a radially outer portion of an outer edge which is formed to overlapped with the discharge opening in the radial direction.

18. The variable displacement pump as claimed in claim 16, wherein the back pressure introduction groove is a first back pressure introduction groove; the variable displacement pump further comprises a second back pressure introduction groove which is the back pressure introduction groove formed in the discharge region side; and the discharge side thin wall portion includes a radially inner side portion of an outer edge which is overlapped with the second back pressure introduction groove on the discharge region side in the radial direction.

19. The variable displacement pump as claimed in claim 16, wherein the second housing has an axial thickness in the discharge region side which is smaller than an axial thickness in the suction region side, in an overlap region in which the second housing is overlapped with the cam ring in the radial direction.

20. The variable displacement pump as claimed in claim 19, wherein the second housing includes a taper portion which is located in the overlap region in which the second housing is overlapped with the cam ring in the radial direction, which is located at a middle portion between the discharge region side and the suction region side, and in which an axial thickness of the second housing is gradually increased toward the suction region.

* * * * *